US007726982B2

(12) United States Patent
Ngo

(10) Patent No.: US 7,726,982 B2
(45) Date of Patent: Jun. 1, 2010

(54) ELECTRICAL CONNECTORS WITH AIR-CIRCULATION FEATURES

(75) Inventor: Hung Viet Ngo, Harrisburg, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 0 days.

(21) Appl. No.: 11/744,428

(22) Filed: May 4, 2007

(65) Prior Publication Data

US 2007/0293084 A1 Dec. 20, 2007

Related U.S. Application Data

(60) Provisional application No. 60/814,275, filed on Jun. 15, 2006.

(51) Int. Cl.
*H01R 12/00* (2006.01)

(52) U.S. Cl. ..... 439/79; 439/206

(58) Field of Classification Search ..... 439/79, 439/101, 190, 206, 485, 637
See application file for complete search history.

(56) References Cited

U.S. PATENT DOCUMENTS

| | | | | |
|---|---|---|---|---|
| 318,186 | A | 5/1885 | Hertzog | |
| 741,052 | A | 10/1903 | Mahon | |
| 1,477,527 | A | 12/1923 | Bruno | 200/282 |
| 2,248,675 | A | 7/1941 | Huppert | 113/119 |
| 2,430,011 | A | 11/1947 | Gillentine | 173/361 |
| 2,759,163 | A | 8/1956 | Ustin et al. | 439/866 |
| 2,762,022 | A | 9/1956 | Benander et al. | 439/290 |
| 2,844,644 | A | 7/1958 | Soule, Jr. | 174/354 |
| 3,011,143 | A | 11/1961 | Dean | 339/49 |
| 3,178,669 | A | 4/1965 | Roberts | 339/49 |
| 3,208,030 | A | 9/1965 | Evans et al. | |
| 3,286,220 | A | 11/1966 | Marley et al. | 439/680 |
| 3,411,127 | A | 11/1968 | Adams | 339/47 |
| 3,420,087 | A | 1/1969 | Hatfield et al. | |
| 3,514,740 | A | 5/1970 | Filson | 439/290 |
| 3,538,486 | A | 11/1970 | Shlesinger, Jr. | 439/268 |
| 3,634,811 | A | 1/1972 | Teagno et al. | 339/47 |
| 3,669,054 | A | 6/1972 | Desso et al. | 113/119 |
| 3,692,994 | A | 9/1972 | Hirschmann et al. | 240/11.4 |
| 3,748,633 | A | 7/1973 | Lundergan | 339/217 |
| 3,845,451 | A | 10/1974 | Neidecker | 339/49 |

(Continued)

FOREIGN PATENT DOCUMENTS

| | | |
|---|---|---|
| DE | 1 665 181 | 4/1974 |

(Continued)

OTHER PUBLICATIONS

Finan, J.M., "Thermally Conductive Thermoplastics", LNP Engineering Plastics, Inc., Plastics Engineering 2000, www.4spe.org, 4 pages.

(Continued)

*Primary Examiner*—Edwin A. Leon
*Assistant Examiner*—Vanessa Girardi
(74) *Attorney, Agent, or Firm*—Woodcock Washburn LLP

(57) ABSTRACT

Embodiments of electrical connectors include features that facilitate circulation of air through and around the electrical connectors. The air can cool the power contacts of the electrical connectors, thereby allowing the power contacts to operate at higher currents that would otherwise be possible.

24 Claims, 13 Drawing Sheets

U.S. PATENT DOCUMENTS

| | | | | |
|---|---|---|---|---|
| 3,871,015 | A | 3/1975 | Lin et al. | 357/67 |
| 3,942,856 | A | 3/1976 | Mindheim et al. | 339/74 |
| 3,972,580 | A | 8/1976 | Pemberton et al. | 339/47 |
| 4,070,088 | A | 1/1978 | Vaden | 439/825 |
| 4,076,362 | A | 2/1978 | Ichimura | 339/75 |
| 4,082,407 | A | 4/1978 | Smorzaniuk et al. | |
| 4,136,919 | A | 1/1979 | Howard et al. | 339/75 |
| 4,159,861 | A | 7/1979 | Anhalt | 339/75 |
| 4,217,024 | A | 8/1980 | Aldridge et al. | 339/275 |
| 4,260,212 | A | 4/1981 | Ritchie et al. | 339/97 |
| 4,288,139 | A | 9/1981 | Cobaugh et al. | 339/74 |
| 4,371,912 | A | 2/1983 | Guzik | 361/417 |
| 4,383,724 | A | 5/1983 | Verhoevan | 439/510 |
| 4,402,563 | A | 9/1983 | Sinclair | 339/75 |
| 4,403,821 | A | 9/1983 | Zimmerman et al. | 339/97 |
| 4,473,113 | A | 9/1984 | Whitfield et al. | |
| 4,505,529 | A | 3/1985 | Barkus | 439/82 |
| 4,533,187 | A | 8/1985 | Kirkman | |
| 4,536,955 | A | 8/1985 | Gudgeon | 29/840 |
| 4,545,610 | A | 10/1985 | Lakritz et al. | 29/589 |
| 4,552,425 | A | 11/1985 | Billman | 339/47 |
| 4,560,222 | A | 12/1985 | Dambach | 339/75 |
| 4,564,259 | A | 1/1986 | Vandame | 439/852 |
| 4,596,433 | A | 6/1986 | Oesterheld et al. | 339/112 |
| 4,685,886 | A | 8/1987 | Denlinger et al. | 439/55 |
| 6,685,886 | B2 | 8/1987 | Denlinger et al. | 439/55 |
| 4,717,360 | A | 1/1988 | Czaja | 439/710 |
| 4,767,344 | A | 8/1988 | Noschese | 439/83 |
| 4,776,803 | A | 10/1988 | Pretchel et al. | 439/59 |
| 4,782,893 | A | 11/1988 | Thomas | |
| 4,790,763 | A | 12/1988 | Weber et al. | |
| 4,815,987 | A | 3/1989 | Kawano et al. | 439/263 |
| 4,818,237 | A | 4/1989 | Weber | |
| 4,820,169 | A | 4/1989 | Weber et al. | |
| 4,820,182 | A | 4/1989 | Harwath et al. | 439/290 |
| 4,867,713 | A | 9/1989 | Ozu et al. | 439/833 |
| 4,878,611 | A | 11/1989 | LoVasco et al. | 228/180.2 |
| 4,881,905 | A | 11/1989 | Demler, Jr. et al. | 439/79 |
| 4,900,271 | A | 2/1990 | Colleran et al. | 439/595 |
| 4,907,990 | A | 3/1990 | Bertho et al. | 439/851 |
| 4,915,641 | A | 4/1990 | Miskin et al. | |
| 4,963,102 | A | 10/1990 | Gettig et al. | 439/291 |
| 4,965,699 | A | 10/1990 | Jorden et al. | |
| 4,973,257 | A | 11/1990 | Lhotak | 439/81 |
| 4,973,271 | A | 11/1990 | Ishizuka et al. | 439/839 |
| 4,974,119 | A | 11/1990 | Martin | |
| 4,975,084 | A | 12/1990 | Fedder et al. | |
| 4,979,074 | A | 12/1990 | Morley et al. | |
| 5,016,968 | A | 5/1991 | Hammond et al. | |
| 5,024,610 | A | 6/1991 | French et al. | 439/857 |
| 5,035,639 | A | 7/1991 | Kilpatrick et al. | 439/290 |
| 5,046,960 | A | 9/1991 | Fedder et al. | |
| 5,052,953 | A | 10/1991 | Weber | 439/857 |
| 5,066,236 | A | 11/1991 | Broeksteeg | 439/79 |
| 5,077,893 | A | 1/1992 | Mosquera et al. | 29/882 |
| 5,082,459 | A | 1/1992 | Billman et al. | 439/637 |
| 5,094,634 | A | 3/1992 | Dixon et al. | 431/751 |
| 5,104,332 | A | 4/1992 | McCoy | 439/290 |
| 5,137,959 | A | 8/1992 | Block et al. | |
| 5,139,426 | A | 8/1992 | Barkus et al. | |
| 5,151,056 | A | 9/1992 | McClune | |
| 5,152,700 | A | 10/1992 | Bogursky et al. | |
| 5,174,770 | A | 12/1992 | Sasaki et al. | 439/108 |
| 5,194,480 | A | 3/1993 | Block et al. | |
| 5,213,868 | A | 5/1993 | Liberty et al. | |
| 5,214,308 | A | 5/1993 | Nishiguchi et al. | 257/692 |
| 5,238,414 | A | 8/1993 | Yaegashi et al. | 439/108 |
| 5,254,012 | A | 10/1993 | Wang | 439/263 |
| 5,274,918 | A | 1/1994 | Reed | 29/882 |
| 5,276,964 | A | 1/1994 | Anderson, Jr. et al. | |
| 5,286,212 | A | 2/1994 | Broeksteeg | |
| 5,295,843 | A | 3/1994 | Davis et al. | |
| 5,298,791 | A | 3/1994 | Liberty et al. | |
| 5,302,135 | A | 4/1994 | Lee | 439/263 |
| 5,321,582 | A | 6/1994 | Casperson | |
| 5,381,314 | A | 1/1995 | Rudy, Jr. et al. | 361/712 |
| 5,400,949 | A | 3/1995 | Hirvonen et al. | 228/180.22 |
| 5,427,543 | A | 6/1995 | Dynia | 439/346 |
| 5,431,578 | A | 7/1995 | Wayne | 439/259 |
| 5,457,342 | A | 10/1995 | Herbst, II | 257/712 |
| 5,458,426 | A | 10/1995 | Ito | |
| 5,475,922 | A | 12/1995 | Tamura et al. | 29/881 |
| 5,490,040 | A | 2/1996 | Gavdenzi et al. | 361/773 |
| 5,512,519 | A | 4/1996 | Hwang | |
| 5,533,915 | A | 7/1996 | Deans | 439/678 |
| 5,558,542 | A | 9/1996 | O'Sullivan et al. | 439/682 |
| 5,564,952 | A | 10/1996 | Davis et al. | |
| 5,577,928 | A | 11/1996 | Duclos | 439/290 |
| 5,582,519 | A | 12/1996 | Buchter | |
| 5,588,859 | A | 12/1996 | Maurice | 439/290 |
| 5,590,463 | A | 1/1997 | Feldman et al. | 29/844 |
| 5,609,502 | A | 3/1997 | Thumma | 439/747 |
| 5,618,187 | A | 4/1997 | Goto | 439/79 |
| 5,637,008 | A | 6/1997 | Kozel | 439/342 |
| 5,643,009 | A | 7/1997 | Dinkel et al. | |
| 5,664,968 | A | 9/1997 | Mickievicz | |
| 5,664,973 | A | 9/1997 | Emmert et al. | 439/862 |
| 5,667,392 | A | 9/1997 | Kocher et al. | |
| 5,691,041 | A | 11/1997 | Frankeny et al. | 428/209 |
| 5,702,255 | A | 12/1997 | Murphy et al. | 439/71 |
| 5,727,963 | A | 3/1998 | LeMaster | |
| 5,730,609 | A | 3/1998 | Harwath | 439/108 |
| 5,741,144 | A | 4/1998 | Elco et al. | 439/101 |
| 5,741,161 | A | 4/1998 | Cahaly et al. | 439/709 |
| 5,742,484 | A | 4/1998 | Gillette et al. | 361/789 |
| 5,743,009 | A | 4/1998 | Matsui et al. | 29/843 |
| 5,745,349 | A | 4/1998 | Lemke | 361/818 |
| 5,746,608 | A | 5/1998 | Taylor | 439/70 |
| 5,749,746 | A | 5/1998 | Tan et al. | |
| 5,755,595 | A | 5/1998 | Davis et al. | 439/607 |
| 5,772,451 | A | 6/1998 | Dozier, II et al. | 439/70 |
| 5,782,644 | A | 7/1998 | Kiat | |
| 5,787,971 | A | 8/1998 | Dodson | 165/121 |
| 5,795,191 | A | 8/1998 | Preputnick et al. | 439/608 |
| 5,810,607 | A | 9/1998 | Shih et al. | 439/66 |
| 5,817,973 | A | 10/1998 | Elco et al. | 174/32 |
| 5,827,094 | A | 10/1998 | Aizawa et al. | |
| 5,831,314 | A | 11/1998 | Wen | 257/391 |
| 5,857,857 | A | 1/1999 | Fukuda | 439/188 |
| 5,874,776 | A | 2/1999 | Kresge et al. | 257/747 |
| 5,876,219 | A | 3/1999 | Taylor et al. | 439/74 |
| 5,876,248 | A | 3/1999 | Brunker et al. | |
| 5,882,214 | A | 3/1999 | Hillbish et al. | |
| 5,883,782 | A | 3/1999 | Thurston et al. | 364/704 |
| 5,888,884 | A | 3/1999 | Wojnarowski | 438/462 |
| 5,908,333 | A | 6/1999 | Perino et al. | 439/631 |
| 5,919,050 | A | 7/1999 | Kehley et al. | 439/71 |
| 5,930,114 | A | 7/1999 | Kuzmin et al. | 361/704 |
| 5,955,888 | A | 9/1999 | Frederickson et al. | 324/761 |
| 5,961,355 | A | 10/1999 | Morlion et al. | 439/686 |
| 5,971,817 | A | 10/1999 | Longueville | 439/857 |
| 5,975,921 | A | 11/1999 | Shuey | 439/83 |
| 5,980,270 | A | 11/1999 | Fjelstad et al. | 439/71 |
| 5,980,321 | A | 11/1999 | Cohen et al. | 439/608 |
| 5,984,726 | A | 11/1999 | Wu | 439/607 |
| 5,993,259 | A | 11/1999 | Stokoe et al. | 439/608 |
| 6,012,948 | A | 1/2000 | Wu | 439/567 |
| 6,036,549 | A | 3/2000 | Wulff | |
| 6,041,498 | A | 3/2000 | Hillbish et al. | |
| 6,050,862 | A | 4/2000 | Ishii | 439/843 |
| 6,059,170 | A | 5/2000 | Jimarez et al. | 228/119 |
| 6,066,048 | A | 5/2000 | Lees | |
| 6,068,520 | A | 5/2000 | Winings et al. | 439/676 |
| 6,071,152 | A | 6/2000 | Achammer et al. | 439/733.1 |

6,077,130 A 6/2000 Hughes et al. ..... 439/862
6,089,878 A 7/2000 Meng ..... 439/79
6,095,827 A 8/2000 Dutkowsky et al. ..... 439/83
6,123,554 A 9/2000 Ortega et al. ..... 439/79
6,125,535 A 10/2000 Chiou et al. ..... 29/883
6,139,336 A 10/2000 Olson ..... 439/83
6,146,157 A 11/2000 Lenoir et al. ..... 439/101
6,146,202 A 11/2000 Ramey et al. ..... 439/608
6,146,203 A 11/2000 Elco et al. ..... 439/608
6,152,756 A 11/2000 Huang et al. ..... 439/342
6,174,198 B1 1/2001 Wu et al. ..... 439/541.5
6,180,891 B1 1/2001 Murdeshwar ..... 174/260
6,183,287 B1 2/2001 Po
6,183,301 B1 2/2001 Paagman ..... 439/608
6,190,213 B1 2/2001 Reichart et al. ..... 439/736
6,193,537 B1 2/2001 Harper, Jr. et al. ..... 439/291
6,196,871 B1 3/2001 Szu ..... 439/571
6,202,916 B1 3/2001 Updike et al. ..... 228/180
6,206,722 B1 3/2001 Ko et al.
6,210,197 B1 4/2001 Yu ..... 439/342
6,210,240 B1 4/2001 Comerci et al. ..... 439/853
6,212,755 B1 4/2001 Shimada et al. ..... 29/527.1
6,215,180 B1 4/2001 Chen et al. ..... 257/720
6,219,913 B1 4/2001 Uchiyama ..... 29/883
6,220,884 B1 4/2001 Lin ..... 439/342
6,220,895 B1 4/2001 Lin ..... 439/607
6,220,896 B1 4/2001 Bertoncici et al. ..... 439/608
6,234,851 B1 5/2001 Phillips ..... 439/825
6,238,225 B1 5/2001 Middlehurst et al.
6,257,478 B1 7/2001 Straub ..... 228/6.2
6,259,039 B1 7/2001 Chroneos, Jr. et al. ..... 174/263
6,261,132 B1 7/2001 Koseki et al.
6,269,539 B1 8/2001 Takahashi et al. ..... 29/883
6,274,474 B1 8/2001 Caletka et al. ..... 438/613
6,280,230 B1 8/2001 Takase et al.
6,293,827 B1 9/2001 Stokoe et al. ..... 439/608
6,299,492 B1 10/2001 Pierini et al. ..... 439/884
6,309,245 B1 10/2001 Sweeney ..... 439/507
6,319,075 B1 11/2001 Clark et al. ..... 439/825
6,322,377 B2 11/2001 Middlehurst et al.
6,328,602 B1 12/2001 Yamasaki et al. ..... 439/608
6,347,952 B1 2/2002 Hasegawa et al. ..... 439/608
6,350,134 B1 2/2002 Fogg et al. ..... 439/79
6,359,783 B1 3/2002 Noble ..... 361/704
6,360,940 B1 3/2002 Bolde et al. ..... 228/264
6,362,961 B1 3/2002 Chiou ..... 361/704
6,363,607 B1 4/2002 Chen et al. ..... 29/883
6,371,773 B1 4/2002 Crofoot et al. ..... 439/79
6,379,188 B1 4/2002 Cohen et al. ..... 439/608
6,386,924 B2 5/2002 Long
6,394,818 B1 5/2002 Smalley, Jr.
6,402,566 B1 6/2002 Middlehurst et al.
6,409,543 B1 6/2002 Astbury, Jr. et al. ..... 439/608
6,428,328 B2 8/2002 Haba et al. ..... 439/70
6,431,914 B1 8/2002 Billman ..... 439/608
6,435,914 B1 8/2002 Billman ..... 439/608
6,450,289 B1 9/2002 Weisz-Margulescu
6,461,183 B1 10/2002 Ohkita et al.
6,461,202 B2 10/2002 Kline ..... 439/701
6,471,523 B1 10/2002 Shuey ..... 439/63
6,471,548 B2 10/2002 Bertoncini et al. ..... 439/608
6,472,474 B2 10/2002 Burkhardt et al.
6,488,549 B1 12/2002 Weller et al.
6,489,567 B2 12/2002 Zachrai
6,506,081 B2 1/2003 Blanchfield et al. ..... 439/682
6,514,103 B2 * 2/2003 Pape et al. ..... 439/608
6,537,111 B2 3/2003 Brammer et al. ..... 439/857
6,544,046 B1 4/2003 Hahn et al. ..... 439/83
6,551,112 B1 4/2003 Li et al. ..... 439/66
6,554,647 B1 4/2003 Cohen et al. ..... 439/607
6,572,410 B1 6/2003 Volstorf et al. ..... 439/608
6,575,774 B2 6/2003 Ling et al.
6,575,776 B1 6/2003 Conner et al.
6,592,381 B2 7/2003 Cohen et al. ..... 439/80
6,604,967 B2 8/2003 Middlehurst et al.
6,629,854 B2 10/2003 Murakami
6,652,318 B1 11/2003 Winings et al. ..... 439/608
6,663,426 B2 12/2003 Hasircoglu et al. ..... 439/608
6,665,189 B1 12/2003 Lebo ..... 361/730
6,669,514 B2 12/2003 Wiebking et al. ..... 439/701
6,672,884 B1 1/2004 Toh et al.
6,672,907 B2 1/2004 Azuma ..... 439/682
6,692,272 B2 2/2004 Lemke et al. ..... 439/108
6,702,594 B2 3/2004 Lee et al. ..... 439/83
6,705,902 B1 3/2004 Yi et al. ..... 439/678
6,712,621 B2 3/2004 Li et al. ..... 439/65
6,716,068 B2 4/2004 Wu ..... 439/733.1
6,740,820 B2 5/2004 Cheng ..... 174/260
6,743,037 B2 6/2004 Kassa et al. ..... 439/342
6,746,278 B2 6/2004 Nelson et al. ..... 439/608
6,769,883 B2 8/2004 Brid et al.
6,769,935 B2 * 8/2004 Stokoe et al. ..... 439/608
6,776,635 B2 8/2004 Blanchfield et al. ..... 439/181
6,776,649 B2 8/2004 Pape et al. ..... 439/485
6,780,027 B2 8/2004 Allison
6,790,088 B2 9/2004 Ono et al. ..... 439/607
6,796,831 B1 9/2004 Yasufuku et al. ..... 439/485
6,810,783 B1 11/2004 Larose
6,811,440 B1 11/2004 Rothermel et al. ..... 439/608
6,814,590 B2 * 11/2004 Minich et al. ..... 439/79
6,829,143 B2 12/2004 Russell et al. ..... 361/704
6,835,103 B2 12/2004 Middlehurst et al. ..... 439/699.1
6,843,687 B2 1/2005 McGowan et al. ..... 439/608
6,848,950 B2 2/2005 Allison et al. ..... 439/682
6,848,953 B2 2/2005 Schell et al. ..... 439/825
6,869,294 B2 3/2005 Clark et al. ..... 439/79
6,884,117 B2 4/2005 Korsunsky et al. ..... 439/607
6,890,221 B2 5/2005 Wagner ..... 439/855
6,905,367 B2 6/2005 Crane, Jr. et al. ..... 439/608
6,923,685 B2 8/2005 Holmes et al.
6,929,504 B2 8/2005 Ling et al. ..... 439/485
6,947,012 B2 9/2005 Aisenbrey ..... 343/906
6,975,511 B1 12/2005 Lebo et al. ..... 361/703
6,994,569 B2 2/2006 Minich et al. ..... 439/79
7,001,189 B1 2/2006 McGowan et al. ..... 439/79
7,059,892 B1 6/2006 Trout
7,059,919 B2 6/2006 Clark et al.
7,065,871 B2 6/2006 Minich et al.
7,070,464 B2 7/2006 Clark et al. ..... 439/825
7,074,096 B2 7/2006 Copper et al. ..... 439/843
7,097,465 B1 8/2006 Korsunsky et al.
7,101,228 B2 9/2006 Hammer et al. ..... 439/637
7,104,812 B1 9/2006 Bogiel et al. ..... 439/79
7,114,963 B2 10/2006 Shuey et al. ..... 439/79
RE39,380 E 11/2006 Davis
7,137,848 B1 11/2006 Trout et al.
7,168,963 B2 1/2007 Minich et al. ..... 439/79
7,182,642 B2 2/2007 Ngo et al. ..... 439/608
7,204,699 B2 4/2007 Stoner et al.
D542,736 S 5/2007 Riku ..... D13/147
7,220,141 B2 5/2007 Daily et al.
7,258,562 B2 8/2007 Daily et al.
7,273,382 B2 9/2007 Igarashi et al.
7,303,427 B2 12/2007 Swain
7,335,043 B2 2/2008 Ngo et al.
7,384,289 B2 6/2008 Minich
7,425,145 B2 9/2008 Ngo
7,458,839 B2 12/2008 Ngo
7,476,108 B2 1/2009 Swain et al.
2001/0003685 A1 6/2001 Aritani ..... 439/485
2001/0049229 A1 12/2001 Pape et al.
2002/0106930 A1 8/2002 Pape et al. ..... 439/485
2002/0142676 A1 10/2002 Hosaka et al. ..... 439/874
2002/0159235 A1 10/2002 Miller et al. ..... 361/704
2002/0193019 A1 12/2002 Blanchfield et al. ..... 439/857
2003/0013330 A1 1/2003 Takeuchi ..... 439/83

| | | | | |
|---|---|---|---|---|
| 2003/0119378 | A1 | 6/2003 | Avery | |
| 2003/0143894 | A1 | 7/2003 | Kline et al. | 439/608 |
| 2003/0219999 | A1 | 11/2003 | Minich et al. | 439/79 |
| 2003/0220021 | A1 | 11/2003 | Whiteman, Jr. et al. | 439/608 |
| 2003/0236035 | A1 | 12/2003 | Kuroda et al. | 439/857 |
| 2004/0147177 | A1 | 7/2004 | Wagner | |
| 2004/0183094 | A1 | 9/2004 | Caletka et al. | 257/178 |
| 2005/0112952 | A1 | 5/2005 | Wang et al. | 439/660 |
| 2006/0003620 | A1 | 1/2006 | Daily et al. | 439/295 |
| 2006/0128197 | A1 | 6/2006 | McGowan et al. | |
| 2006/0228927 | A1 | 10/2006 | Daily | |
| 2006/0228948 | A1 | 10/2006 | Swain | |
| 2006/0281354 | A1 | 12/2006 | Ngo et al. | 439/290 |
| 2007/0197063 | A1 | 8/2007 | Ngo | |
| 2007/0202748 | A1 | 8/2007 | Daily | |
| 2007/0275586 | A1 | 11/2007 | Ngo | |
| 2008/0038956 | A1 | 2/2008 | Swain | |
| 2008/0248670 | A1 | 10/2008 | Daily et al. | |

FOREIGN PATENT DOCUMENTS

| | | | |
|---|---|---|---|
| DE | 102 26 279 | C1 | 11/2003 |
| EP | 0 273 683 | A2 | 7/1988 |
| EP | 0 321 257 | B1 | 4/1993 |
| EP | 0 623 248 | B1 | 11/1995 |
| EP | 0 789 422 | A2 | 8/1997 |
| EP | 1091449 | B1 | 9/2004 |
| GB | 1 162 705 | | 8/1969 |
| JP | 05344728 | | 12/1993 |
| JP | 06068943 | | 3/1994 |
| JP | 06-236788 | | 8/1994 |
| JP | 07-114958 | | 5/1995 |
| JP | 07169523 | | 7/1995 |
| JP | 08096918 | | 4/1996 |
| JP | 0 812 5379 | | 5/1996 |
| JP | 09199215 | | 7/1997 |
| JP | 2000-003743 | | 1/2000 |
| JP | 2000-003744 | | 1/2000 |
| JP | 2000-003745 | | 1/2000 |
| JP | 2000-003746 | | 1/2000 |
| JP | 13135388 | | 5/2001 |
| JP | 2003-217785 | | 7/2003 |
| KR | 100517651 | | 12/2004 |
| TW | 576555 | | 8/1990 |
| TW | 546872 | | 8/2003 |
| WO | WO 97/43885 | | 11/1997 |
| WO | WO 97/44859 | | 11/1997 |
| WO | WO 98/15989 | | 4/1998 |
| WO | WO 00/16445 | | 3/2000 |
| WO | WO 01/29931 | A1 | 4/2001 |
| WO | WO 01/39332 | A1 | 5/2001 |
| WO | WO 02/103847 | | 12/2002 |
| WO | WO 2005/065254 | | 7/2005 |
| WO | WO 2007/064632 | | 6/2007 |

OTHER PUBLICATIONS

Sherman, L.M., "Plastics that Conduct Heat", Plastics Technology Online, Jun. 2001, http://www.plasticstechnology.com, 4 pages.

Ogando, J., "And now-An Injection-Molded Heat Exchanger", Sure, plastics are thermal insulators, but additive packages allow them to conduct heat instead, Global Design News, Nov. 1, 2000, 4 pages.

U.S. Appl. No. 11/019,777 by Daily, C.G. filed Dec. 21, 2004.

Metral 1000 Series, PCB Mounted Receptacle Assembly, FCI Web Site p. 2001, 1 p.

Power TwinBlade™ I/O Cable Connector RA-North-South, No. Gs-20_072, Aug. 6, 2007, 11 pages.

Product Datasheets, 10 Bgit/s XENPAK 850 nm Transponder (TRP10GVP2045), Copyright 2005, MergeOptics GmbH, 13 pages.

Product Datasheets, Welome to XENPAK.org., Copyright 2001, http://www.xenpak.org., 1 page.

* cited by examiner

ELECTRICAL CONNECTORS WITH AIR-CIRCULATION FEATURES

CROSS-REFERENCE TO RELATED APPLICATIONS

This application claims priority under 35 U.S.C. § 119(e) to U.S. provisional application No. 60/814,275, filed Jun. 15, 2006, the contents of which is incorporated by reference herein in its entirety.

This application is related to patent application Ser. No. 11/019,777, filed Dec. 21, 2004; application Ser. No. 11/408,437, filed Apr. 21, 2006; application Ser. No. 11/441,856, filed May 26, 2006; U.S. Pat. No. 7,335,043 filed Jun. 9, 2006; and application Ser. No. 11/451,828 filed Jun. 12, 2006, all of which are incorporated herein by reference.

TECHNICAL FIELD

The present invention relates to electrical connectors for transmitting electrical power.

BACKGROUND

Power contacts typically experience a temperature rise during operation, due the passage of electrical current therethrough. The temperature rise, if excessive, can melt or otherwise damage the power contact, its housing, and other hardware located in the vicinity of the power contact. The temperature rise in a power contact, in general, is proportional to the current level in the power contact. Thus, the maximum rated current of a power contact is typically limited by the maximum acceptable temperature rise in the power contact.

Increasing the operating current of an electronic device, in general, permits the device to operate at a lower voltage than would otherwise be possible. Manufacturers of electronic devices therefore often request or require power contacts with relatively high current ratings. Consequently, it is desirable to minimize the temperature rise experienced by power contacts during operation.

SUMMARY

Embodiments of electrical connectors include features that facilitate circulation of air through and around the electrical connectors. The air can cool the power contacts of the electrical connectors, thereby allowing the power contacts to operate at higher currents that would otherwise be possible.

Embodiments of connector systems comprise a first electrical connector comprising an electrically-insulative housing that defines a cavity. The housing has an aperture formed therein that places the cavity in fluid communication with the environment around the first electrical connector. The first electrical connector also comprises a power contact having a mating portion located in the cavity.

The connector system also comprises a second electrical connector that mates with the first electrical connector. The second electrical connector comprises an electrically-insulative housing that defines a cavity. The housing of the second electrical connector has an aperture formed therein that places the cavity of the second electrical connector in fluid communication with the environment around the second electrical connector. The second electrical connector also comprises a power contact having a mating portion located in the cavity of the housing of the second electrical connector.

The apertures formed in the housings of the first and second electrical connectors overlap when the first and second electrical connectors are mated.

Embodiments of electrical connectors for mounting on a substrate comprise a power contact and an electrically insulative housing that receives the power contact. An aperture is formed in the housing. The aperture is aligned with a mating portion of power contact whereby air heated by the power contact can exit the power contact by way of the aperture. A recess is formed in the housing. The recess faces the substrate, and the recess and the substrate define a passage extending from a side portion of the housing when the electrical connector is mounted on the substrate. A portion of the power contact extends through the recess, whereby air from the environment around the electrical connector can pass between the housing and substrate and over the power contact.

Embodiments of electrical connectors comprise an electrically insulative housing, and a power contact mounted in the housing and having a mating portion. The housing has an aperture formed therein and aligned with the mating portion of the contact whereby air heated by the power contact can exit the power contact by way of the aperture.

Embodiments of electrical connectors include a housing and two different types of power contacts. The power contacts include polarizing features that reduce or eliminate the potential for the power contacts to be improperly installed in the housing.

Embodiments of electrical connectors comprise a first power contact comprising a tab; a second power contact comprising a tab; and a housing having a first and a second cavity formed therein that receive the respective first and second power contacts. The tab of the first power contact interferedly contacts the housing when the first power contact is partially inserted into the second cavity thereby preventing installation of the first power contact in the second cavity. The tab of the second power contact interferedly contacts the housing when the second power contact is partially inserted into the first cavity thereby preventing installation of the second power contact in the first cavity.

BRIEF DESCRIPTION OF THE DRAWINGS

The foregoing summary, as well as the following detailed description of a preferred embodiment, are better understood when read in conjunction with the appended diagrammatic drawings. For the purpose of illustrating the invention, the drawings show an embodiment that is presently preferred. The invention is not limited, however, to the specific instrumentalities disclosed in the drawings. In the drawings.

DETAILED DESCRIPTION OF ILLUSTRATIVE EMBODIMENTS

Figure 1:
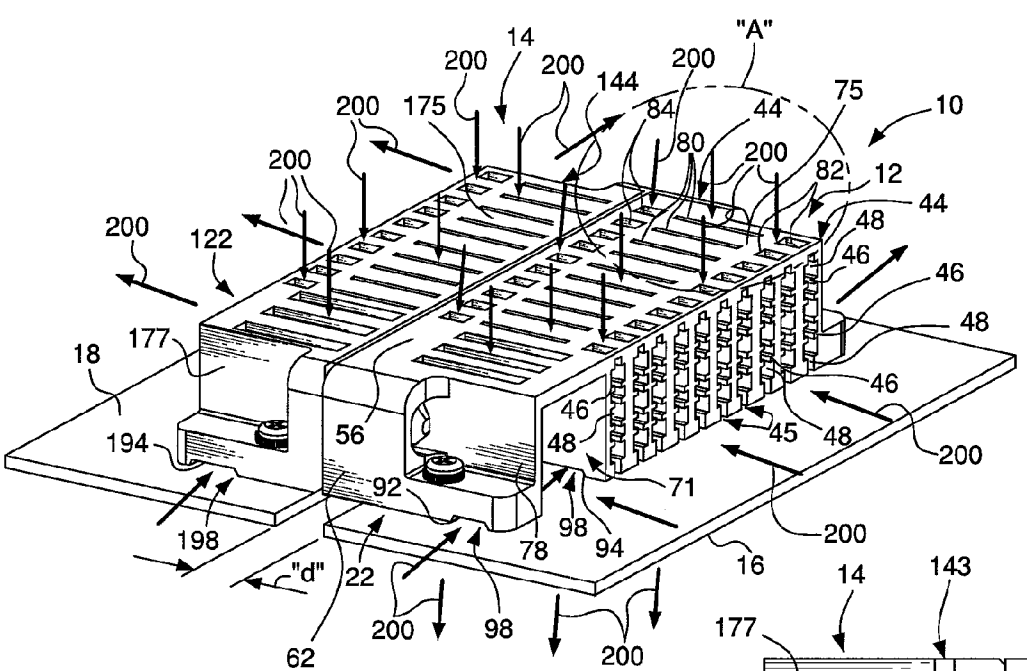
FIG. 1 is a top perspective view of a preferred embodiment of a connector system depicting a header connector and a receptacle connector of the connector system in a fully mated condition.

FIGS. 1 through 12 depict an embodiment of a co-planar connector system 10. The figures are referenced to a common coordinate system 11 depicted therein. The connector system 10 comprises a header connector 12, and a receptacle connector 14 that mates with the header connector 12. The header connector 12 can be mounted on a substrate such as a printed circuit board (PCB) 16, and the receptacle connector 14 can be mounted on a substrate such as a PCB 18. The header connector 12 and the receptacle connector 14, when mated, electrically connect the PCB 16 and the PCB 18.

Figure 11:
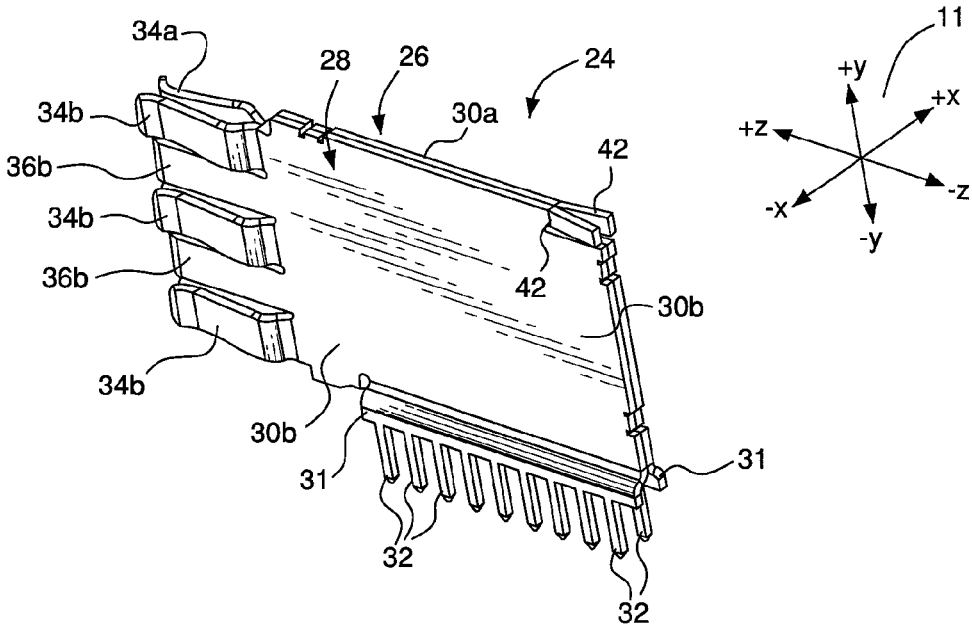
FIGS. 11 and 12 are perspective views of a power contact of the header connector shown in FIGS. 1-10.

The header connector 12 comprises an electrically insulative housing 22, and a plurality of power contacts 24 mounted in the housing 22. Each power contact 24 comprises a first half 26 and a second half 28, as shown in FIG. 11. The first half 26 includes a plate-like body member 30*a*, and a substantially S-shaped portion 31 that adjoins a lower end of the body member 30*a*. The first half 26 also includes a plurality of terminal pins 32 that each extend from a lower end of the S-shaped portion 31.

The first half 26 further includes three angled contact beams 34*a* and two substantially straight contact beams 36*a* that each extend from a forward edge of the body member 30*a*. The angled contact beams 34*a* and the straight contact beams 36*a* are arranged on the body member 30a in a staggered manner, i.e., each straight contact beam 36*a* is positioned adjacent to two of the angled contact beams 34*a*.

Directional terms such as "upper," "lower," "forward," "rearward," "top,""bottom," "above," "below," etc., are used with reference to the component orientations depicted in FIG. 1. These terms are used for exemplary purposes only, and are not intended to limit the scope of the appended claims.

The second half 28 of each power contact 24 includes a plate-like body member 30*b*, and another S-shaped portion 31 that adjoins a lower end of the body member 30*b*. The second half 28 also includes a plurality of terminal pins 32 that each extend from a lower end of the S-shaped portion 31.

The second half 28 further includes three angled contact beams 34*b* and two substantially straight contact beams 36*b* that each extend from a forward edge of the body member 30*b*. The angled contact beams 34*b* and the straight contact beams 36*b* are arranged on the body member 30*b* in a staggered manner, as shown in FIG. 11.

The body members 30*a*, 30*b* are stacked against each other as shown in FIG. 11, so that each angled contact beam 34*a* faces, and is spaced apart from an associated angled contact beam 34*b*; and each straight contact beam 36*a* faces and abuts an associated contact beam 36*b*. The S-shaped portions 31 provide an offset between the terminal pins 32 of the first half 26 and the terminal pins 32 of the second half 28 when the body members 30*a*, 30*b* are stacked.

Each body member 30*a*, 30*b* can include a tab 42 located at an upper rearward corner thereof. The tabs 42 are angled outward, as depicted in FIG. 11. Each tab 42 can contact an associated lip (not shown) on the housing 22 as the power contact 24 is inserted into the housing 22 from the rearward end thereof. Contact between the tab 42 and the lip causes the tab 42 to deflect inward. The tab 42 clears the lip as the power contact 24 approaches its fully-inserted position within the housing 22. The resilience of the tab 42 causes the tab 42 to spring outward, to its original position, once the tab 42 clears the lip. Interference between the tab 42 and the lip can discourage the power contact 24 from backing out of the housing 22.

Specific details of the power contacts 24 are presented for exemplary purposes only. The principles of the present invention can be applied to connectors comprising other types of power contacts, including the power contacts described in the related applications cross-referenced above.

Figure 2:
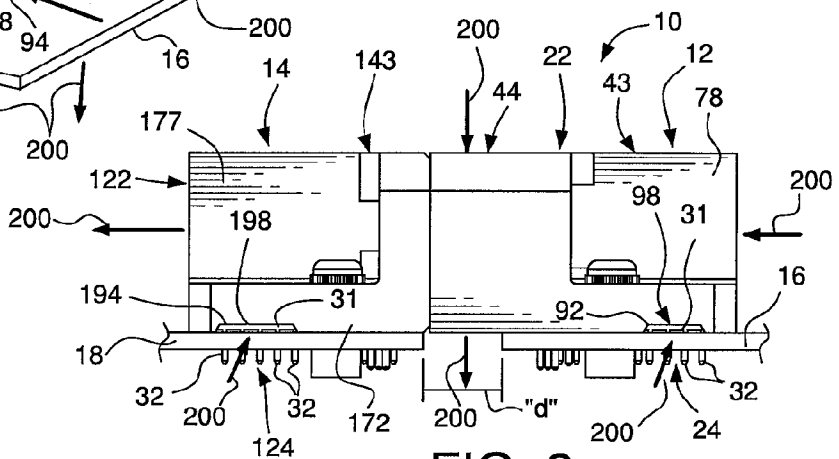
FIG. 2 is a side view of the connector system shown in FIG. 1, depicting the header connector and the receptacle connector in the fully mated condition.
Figure 3:
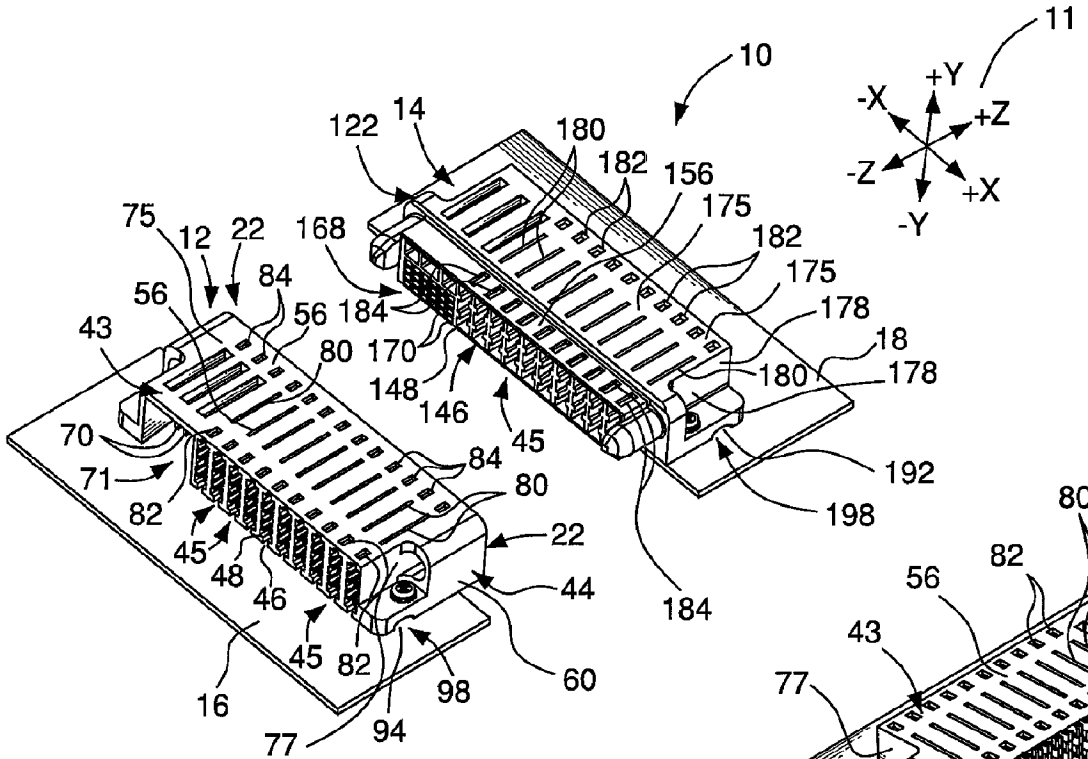
FIG. 3 is a top perspective view of the connector system shown in FIGS. 1 and 2, depicting the header connector and the receptacle connector an unmated condition.

The housing 22 includes a main body 43 and an adjoining mating portion 44, as shown in FIGS. 1 through 4. The main body 43 has a plurality of cavities 45 formed therein, as shown in FIGS. 1 and 3. Each cavity 45 receives the body members 30*a*, 30*b* of an associated power contact 24. The cavities 45 are each defined, in part, by ribs 46 of the housing 22. The ribs 46 are arranged in opposing pairs. The ribs 46 contact the body members 30*a* or 30*b* of the associated power contact 24 as the power contact 24 is slid into the cavity 45.

Interference between the ribs 46 and the body members 30*a*, 30*b* pushes the body members 30*a*, 30*b* together, and helps to retain the power contact 24 in the cavity 45.

The ribs 46 define grooves 48 therebetween, as depicted in FIGS. 1 and 3. The grooves 48, as discussed below, facilitate heat transfer from the power contacts 24 during operation of the header connector 12.

The main body 43 of the housing 22 includes a forward wall 52. The forward wall 52 is depicted, in part, in FIG. 4. The cavities 45 extend through the forward wall 52, so that the angled contact beams 34*a*, 34*b* and the straight contact beams 36*a*, 36*b* of the power contacts 24 can pass through the forward wall 52 when the power contacts 24 are inserted into the housing 22 from the rearward end thereof.

Figure 4:
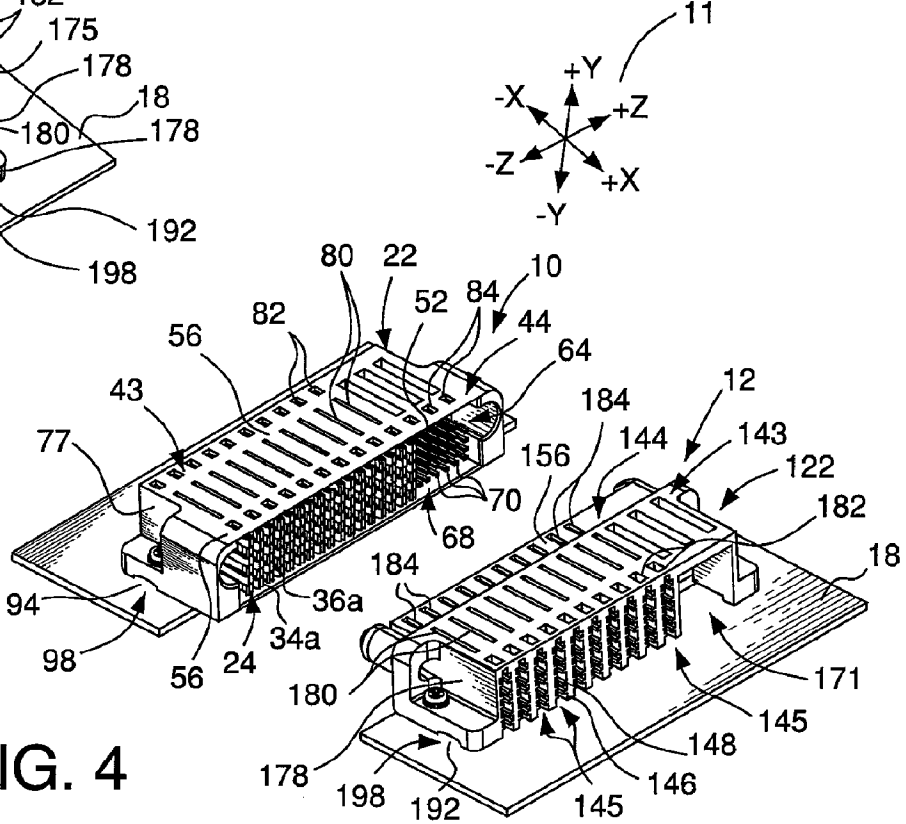
FIG. 4 is a top perspective view of the connector system shown in FIGS. 1-3, depicting the header connector and the receptacle connector the unmated condition.

The mating portion 44 of the housing 22 includes a top portion 56, a bottom portion 58, and side portions 60, 62, as shown in FIGS. 1-4 and 9. The top portion 56, bottom portion 58, side portions 60, 62, and forward wall 52 define a mating zone or cavity 64, as depicted in FIG. 4. The cavity 64 adjoins the cavities 45 of the main body 43. The mating portion 44 overhangs a forward edge of the PCB 16 when the header connector 12 is mounted thereon, as shown in FIGS. 1 through 4 and 9.

The angled contact beams 34*a*, 34*b* and the straight contact beams 36*a*, 36*b* of the power contact 24 extend into the cavity 64, as depicted in FIG. 4. The cavity 64, as discussed below, receives a portion of the receptacle connector 14 when the header and receptacle connectors 12, 14 are mated.

The header connector 12 can include an array 68 of signal contacts 70. The array 68 can be located to one side of the power contacts 24, as shown in FIG. 4. A portion of the array 70 can be positioned in a cavity 71 formed in the housing 22, as shown in FIG. 3. The array 70 can be located at or near the center of the header connector 12, between the power contacts 24, in alternative embodiments of the header connector 12. Other alternative embodiments can forgo the use of any signal contacts 70.

The main body 43 of the housing 22 has a top portion 75, a bottom portion 76, and side portions 77, 78, as shown in FIGS. 1-4. A plurality of elongated slots or apertures 80 are preferably formed in the top portion 75, as shown in FIGS. 1, 3, 4, 5, and 7. Each aperture 80 is located above the body portions 30*a*, 30*b* of the associated power contacts 24. The apertures 80 extend in the widthwise, or "z" direction of the housing 22.

The apertures 80 each adjoin an associated cavity 45, and thereby place the cavity 45 in fluid communication with the environment around the header connector 12. Preferably, the width, or "x" dimension of each aperture 80 is as large as, or greater than the combined width, or "x" dimension, of the body portions 30*a*, 30*b* of the associated power contact 24.

Figure 7:
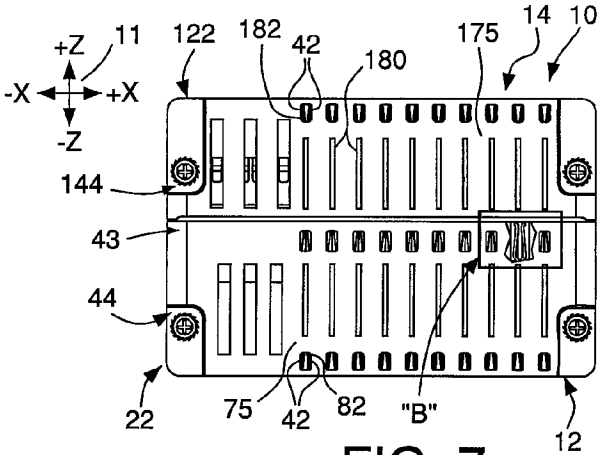
FIG. 7 is top view of the connector system shown in FIGS. 1-6, depicting the header connector and the receptacle connector in the fully mated condition.
Figure 5:
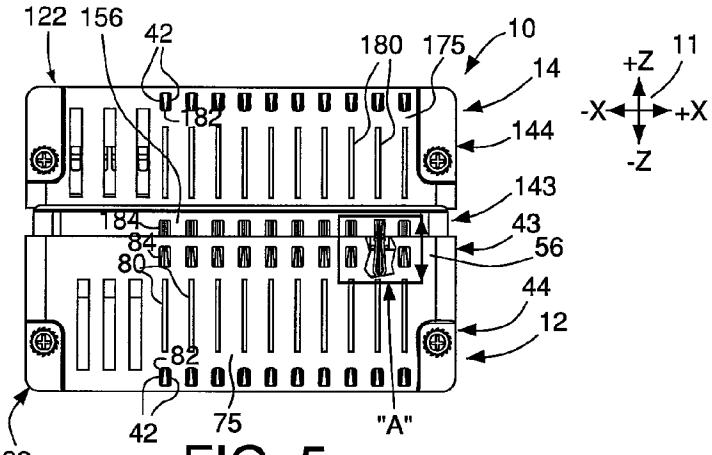
FIG. 5 is top view of the connector system shown in FIGS. 1-4, depicting the header connector and the receptacle connector in a partially mated condition.

Additional apertures 82 are preferably formed in the top portion 75 of the main body 43, proximate the rearward end thereof, as shown in FIGS. 1, 3, 4, 5, and 7. Each aperture 82 adjoins an associated cavity 45 and is located above the tabs 42 of the associated power contact 24, as shown in FIGS. 5 and 7. The apertures 82 place the rearward ends of the cavities 45 in fluid communication with the environment around the header connector 12. Preferably, the width, or "x" dimension of each aperture 82 is about equal to, or greater than the tip-to-tip width of the tabs 42 of the associated power contact 24.

Figure 6:
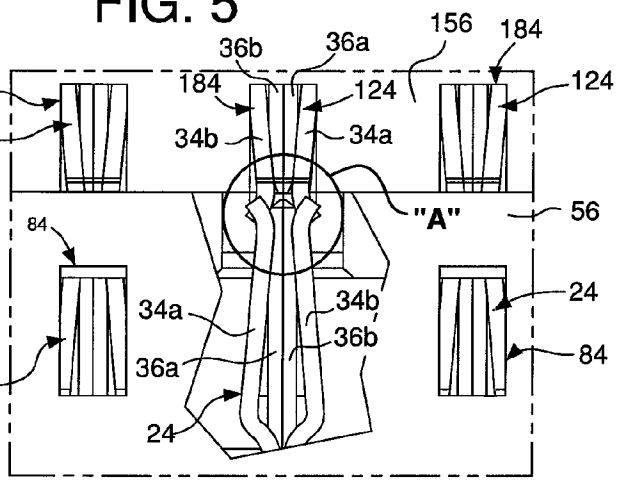
FIG. 6 is a magnified, partial cutaway view of the area designated "A"in FIG. 5.
Figure 8:
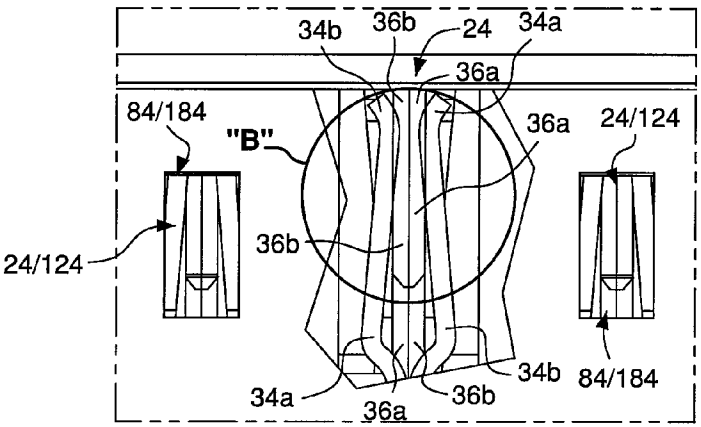
FIG. 8 is a magnified, partial cutaway view of the area designated "B"in FIG. 7.

Apertures 84 are preferably formed in the top portion 56 of the mating portion 44, as shown in FIGS. 1 and 3-8. The apertures 84 adjoin the cavity 64. Each aperture 84 is located above the angled contact beams 34*a*, 34*b* and the straight contact beams 36*a*, 36*b* of an associated power contact 24, i.e., each aperture 84 is aligned with the angled contact beams 34*a*, 34*b* and the straight contact beams 36*a*, 36*b* of the associated power contact 24 in the "y" direction, as shown in FIGS. 6 and 8.

The apertures 84 place the cavity 64 fluid communication with the environment around the header connector 12. Preferably, the width, or "x" dimension of each aperture 84 is as large as, or greater than the combined width of the straight contact beams 36*a*, 36*b* of the associated power contact 24, as shown in FIGS. 6 and 8.

Figure 10:
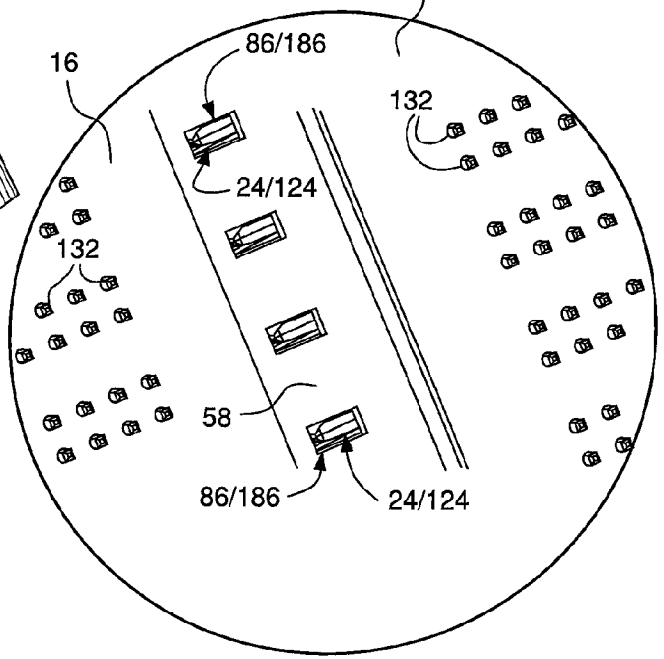
FIG. 10 is a magnified view of the area designated "C" in FIG. 9.
Figure 9:
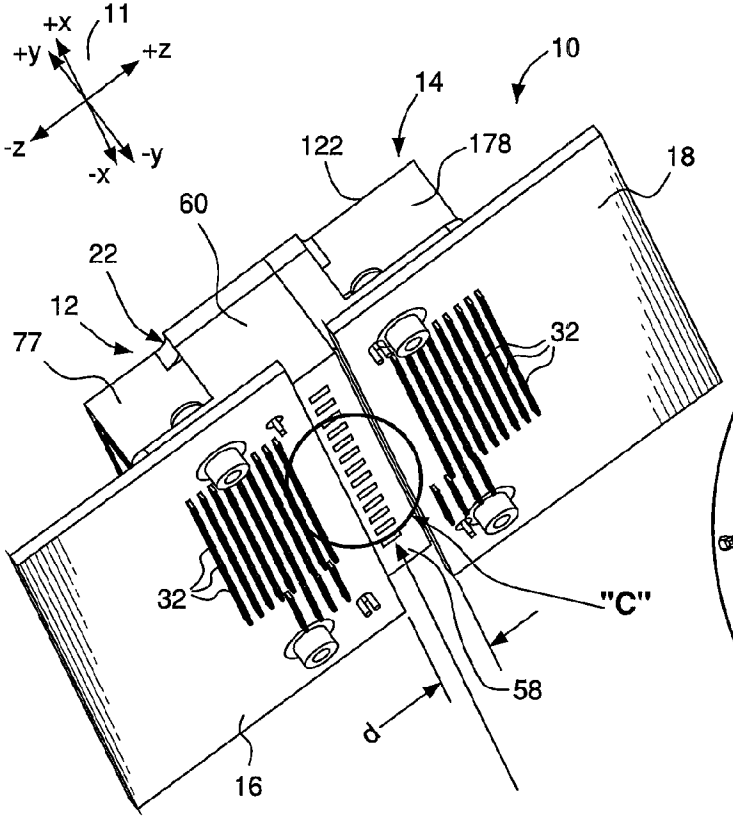
FIG. 9 is bottom perspective view of the connector system shown in FIGS. 1-8, depicting the header connector and the receptacle connector in the fully mated condition.

Apertures 86 are preferably formed in the bottom portion 58 of the mating portion 44, as shown in FIGS. 9 and 10. The apertures 86 adjoin the cavity 64, and are substantially similar to the apertures 84. Each aperture 86 is located below the angled contact beams 34*a*, 34*b* and the straight contact beams 36*a*, 36*b* of the associated power contact 24, i.e., each aperture 86 is aligned with the angled contact beams 34*a*, 34*b* and the straight contact beams 36*a*, 36*b* of the associated power contact 24 in the "y" direction, as shown in FIG. 10. The apertures 86 place the cavity 64 fluid communication with the environment around the header connector 12.

A recess 92 is preferably formed in the bottom portion 76 of the main body 43 of the housing 22, as shown in FIGS. 1 and 2. The recess 92 extends substantially in the lengthwise, or "x" direction of the housing 22, between the side portion 78 and the cavity 71. Another recess 94 is preferably formed in the bottom portion 76, between the side portion 77 and the cavity 71, as shown in FIGS. 3 and 4. The recess 94 substantially aligns with the recess 92 in the "x" direction.

The recesses 92, 94 each face the PCB 16 when the header connector 12 is mounted thereon. The recesses 92, 94, the cavity 71, and the PCB 16 define a passage 98 that extends across the entire length, or "x" dimension of the housing 22.

The receptacle connector 14 comprises an electrically insulative housing 122, and a plurality of power contacts 124 mounted in the housing 122. The power contacts 124 are configured to mate with the power contacts 24 of the header connector 12.

Figure 12:
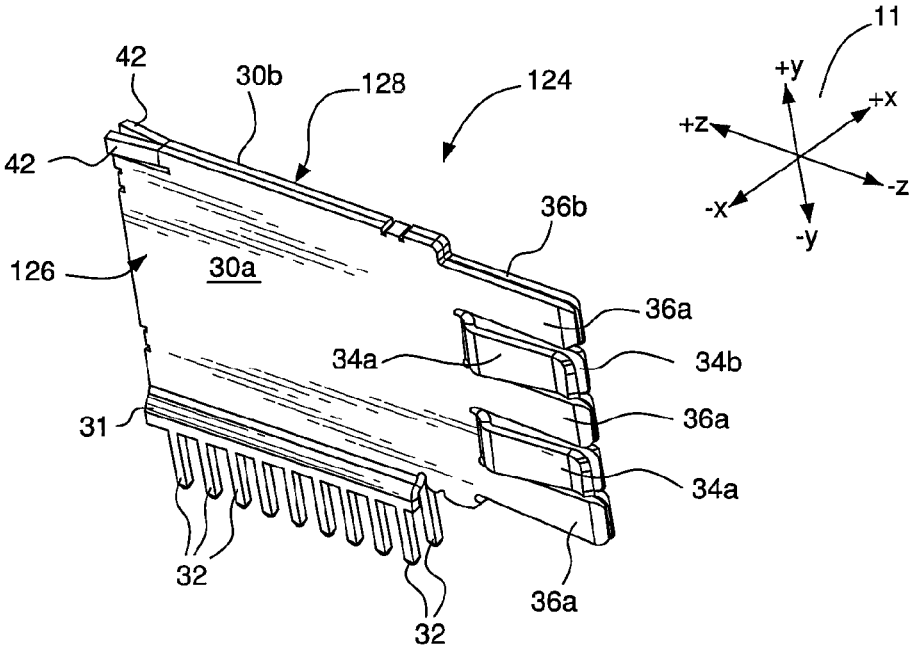

Each power contact 124 includes a first half 126 and a second half 128, as shown in FIG. 12. The power contacts 124 are substantially identical to the power contacts 24, with the exception that the first and second halves 126, 128 each include two of the angled contact beams 34*a* and three of the substantially straight contact beams 36*a*. Portions of the power contacts 124 that are substantially identical to those of the power contacts 24 are denoted in the figures by identical reference numerals.

The angled contact beams 34*a* and the straight contact beams 36*a* of the first half 126 are arranged on the body member 30*a* of the first half 126 in a staggered manner, i.e., each angled contact beam 36*a* is positioned adjacent to two of the straight contact beams 34*a*, as shown in FIG. 12. The angled contact beams 34*b* and the straight contact beams 36*b* likewise are arranged on the body member 30*b* of the second half 128 in a staggered manner.

The housing 122 of the receptacle connector 14 includes a main body 143 and an adjoining mating portion 144, as shown in FIGS. 3 and 4. The mating portion 144, as discussed below, is received within the cavity 64 of the header connector 12 when the header and receptacle connectors 12, 14 are mated.

The housing 122 has a plurality of cavities 145 formed therein, as shown in FIG. 4. The cavities 145 each extend through the main body 143 and the mating portion 144, between the forward and rearward ends the housing 122. Each cavity 145 receives the body members 30*a*, 30*b*, the angled contact beams 34*a*, 34*b*, and the straight contact beams 36*a*, 36*b* of an associated power contact 124. The angled contact beams 34*a,* 34*b,* and the straight contact beams 36*a,* 36*b* of each power contact 124 reside within the mating portion 144 when the power contact 124 is inserted in the housing 122.

Each cavity 145 is defined, in part, by ribs 146 of the housing 122. The ribs 146 are arranged in opposing pairs, as shown in FIG. 4. The ribs 146 contact the body members 30*a* or 30*b* of the associated power contact 124 as the power contact 124 is slid into the cavity 145. Interference between the ribs 146 and the body members 30*a,* 30*b* pushes the body members 30*a,* 30*b* together, and helps to retain the power contact 124 in the cavity 145.

The ribs 146 define grooves 148 therebetween. The grooves 148, as discussed below, facilitate heat transfer from the power contacts 124 during operation of the receptacle connector 14.

The receptacle connector 14 can include an array 168 of signal contacts 170, as shown in FIG. 3. The array 168 can be located to one side of the power contacts 124, as shown in FIG. 3. A portion of the array 168 can be positioned in a cavity 171 formed in the housing 122, as shown in FIG. 4. The array 168 can be located at or near the center of the receptacle connector 14, between the power contacts 124, in alternative embodiments of the receptacle connector 14. Other alternative embodiments can forgo the use of any signal contacts 170.

The main body 143 of the housing 122 has a top portion 175, a bottom portion 176, and side portions 177, 178, as shown in FIGS. 1-4. A plurality of elongated slots or apertures 180 are preferably formed in the top portion 175, as shown in FIGS. 1, 3, 4, 5, and 7. Each aperture 180 is located above the body portions 30*a,* 30*b* of the associated power contacts 124. The apertures 180 extend in the widthwise, or "z"direction of the housing 124. The apertures 180 each adjoin an associated cavity 145, and thereby place the cavity 145 in fluid communication with the environment around the receptacle connector 14. Preferably, the width, or "x" dimension of each aperture 180 is as large as, or greater than the combined width, or "x" dimension, of the body portions 30*a,* 30*b* of the associated power contact 124.

Additional apertures 182 are preferably formed in the top portion 175 of the main body 143, proximate the rearward end thereof. Each aperture 182 adjoins an associated cavity 145 and is located above the tabs 42 of the associated power contact 124, as shown in FIGS. 5 and 7. The apertures 182 place the rearward ends of the cavities 145 in fluid communication with the environment around the receptacle connector 14. The width, or "x" dimension of each aperture 182 is preferably about equal to, or greater than the tip-to-tip width of the tabs 42 of the associated power contact 124, as shown in FIGS. 5 and 7.

The mating portion 144 of the housing 122 overhangs a forward edge of the PCB 18 when the receptacle connector 14 is mounted thereon, as shown in FIGS. 3 and 4. The mating portion 144 has a top portion 156 and a bottom portion (not shown). Apertures 184 are preferably formed in the top portion 156, as shown in FIGS. 3-8. The apertures 184 each adjoin the forward end of an associated cavity 145. Each aperture 184 is located above the angled contact beams 34*a,* 34*b* and the straight contact beams 36*a,* 36*b* of an associated power contact 124, i.e., each aperture 84 is aligned with the angled contact beams 34*a,* 34*b* and the straight contact beams 36*a,* 36*b* of the associated power contact 124 in the "y" direction, as shown in FIGS. 5 and 6.

The apertures 184 place the associated cavity 145 in fluid communication with the environment around the receptacle connector 14. Preferably, the width, or "x"dimension of each aperture 184 is as large as, or greater than the combined width of the straight contact beams 36*a,* 36*b* of the associated power contact 124, as shown in FIG. 6.

Apertures 186 are preferably formed in the bottom portion of the mating portion 144, as shown in FIG. 10. The apertures 186 each adjoin the forward end of an associated cavity 145, and are substantially similar to the apertures 184. Each aperture 186 is located below the angled contact beams 34*a,* 34*b* and the straight contact beams 36*a,* 36*b* of the associated power contact 124, i.e., each aperture 186 is aligned with the angled contact beams 34*a,* 34*b* and the straight contact beams 36*a,* 36*b* of the associated power contact 124 in the "y" direction, as shown in FIG. 10. Each aperture 186 places the associated cavity 145 in fluid communication with the environment around the receptacle connector 14.

A recess 192 is preferably formed in the bottom portion 176 of the main body 143 of the housing 122, as shown in FIGS. 3 and 4. The recess 192 extends substantially in the lengthwise, or "x" direction of the housing 122, between the side portion 178 and the cavity 171. Another recess 194 is preferably formed in the bottom portion 176, between the side portion 177 and the cavity 171, as shown in FIGS. 1 and 2. The recess 194 substantially aligns with the recess 192 in the "x" direction.

The recesses 192, 194 each face the PCB 18 when the receptacle connector 14 is mounted thereon. The recesses 192, 194, the cavity 171, and the PCB 18 define a passage 198 that extends across the entire length, or "x" dimension of the housing 122.

The plug and receptacle connectors 12, 14 are mated by aligning the mating portion 144 of the receptacle connector 14 with the cavity 64 of the plug connector 12. One or both of the plug and receptacle connectors 12, 14 are then moved toward each other, until the mating portion 144 begins to enter the cavity 64. Further movement of the plug and receptacle connectors 12, 14 toward each other causes each of the angled contact beams 34*a,* 34*b* and the straight contact beams 36*a,* 36*b* of the power contacts 24 of the plug connector 12 to enter an associated cavity 145 of the housing 122 of the receptacle connector 14.

Each associated pair of straight contact beams 36*a,* 36*b* of the power contact 24 subsequently enters the space between an associated pair of the angled contact beams 34*a,* 34*b* of the power contact 124, as shown in FIGS. 5 and 6. Contact between the straight contact beams 36*a,* 36*b* and the angled contact beams 34*a,* 34*b* causes the angled contact beams 36*a,* 36*b* to resiliently deflect in an outward direction, i.e., in a direction away from the straight contact beams 34*a,* 34*b*. The resilient deflection of the angled contact beams 34*a,* 34*b* of the power contact 124 results in a contact force between the angled contact beams 34*a,* 34*b* of the power contact 124 and the straight contact beams 36*a,* 36*b* of the power contact 24.

Each associated pair of straight contact beams 36*a,* 36*b* of the power contact 124 likewise enters the space between an associated pair of the angled contact beams 34*a,* 34*b* of the power contact 24. The resulting deflection of the angled contact beams 34*a,* 34*b* of the power contact 24 results in a contact force between the angled contact beams 34*a,* 34*b* of the power contact 124 and the straight contact beams 36*a,* 36*b* of the power contact 124.

The forward edges of the PCB 16 and the PCB 18 are spaced apart by a gap when the plug and receptacle connectors 12, 14 are fully mated. This gap is denoted by the reference character "d" in FIGS. 1, 2, and 9.

The apertures 84 of the housing 22 and the apertures 184 of the housing 122 are positioned so that each aperture 84 overlaps, or substantially aligns with corresponding aperture 184 when the header and receptacle connectors 12, 14 are fully mated, as shown in FIG. 8.

The apertures 86 of the housing 22 and the apertures 186 of the housing 122 likewise are positioned so that each aperture 86 overlaps, or substantially aligns with corresponding aperture 186 when the header and receptacle connectors 12, 14 are fully mated, as shown in FIG. 10.

The apertures 84, 86, 184, 186 facilitate air circulation through the housings 22, 122 and over the power contacts 24, 124. This air circulation can help to cool the power contacts 24, 124 during operation.

For example, FIGS. 1 and 2 include arrows 200 designating one possible manner in which air can circulate through the header and receptacle connectors 12, 14. In this particular scenario, one or more cooling fans (not shown) are used to direct air downward and over the header and receptacle connectors 12, 14. The overlapping apertures 84, 184 permit the relatively cool, downwardly-flowing air to enter the mating portions 44, 144 of the respective housings 22, 122. The air entering the mating portions 44, 144 can displace the air within the mating portions 44, 144, which has been heated by the angled contact beams 34*a*, 34*a* and the straight contact beams 36*a*, 36*b* of the relatively warm power contacts 24, 124.

The lower apertures 86, 186 can permit the heated air that has been displaced within the mating portions 44, 144 by the cooler incoming air to exit the mating portions 44, 144. The gap "d" between the PCBs 16, 18 permits the air exiting the mating portions 44, 144 to flow freely into the environment around the header and receptacle connectors 12, 14.

Heat energy is transferred to the relatively cool air from the angled contact beams 34*a*, 34*b* and the straight contact beams 36*a*, 36*b*, as the air is forced downward and over the angled contact beams 34*a*, 34*b* and the straight contact beams 36*a*, 36*b*. This convective heat transfer cools the angled contact beams 34*a*, 34*b* and the straight contact beams 36*a*, 36*b*, while heating the air. The heated air, in turn, is forced downward and through the overlapping lower apertures 86, 186, giving rise to an air-circulation pattern within the mating portions 44, 144. This circulation dissipates heat energy from the power contacts 24, 124, and thereby cools the power contacts 24, 124.

The apertures 80, 180 also facilitate cooling of the respective power contacts 24, 124 during operation. In particular, the apertures 80, 180 permit the relatively cool air being forced downward over the header and receptacle connectors 12, 14 to impinge upon the top of each body portion 30*a*, 30*b* of the power contacts 24, 124. The impingement of the relatively cool air on the body portions 30*a*, 30*b* helps to dissipate heat energy from the power contacts 24, 124.

The apertures 82, 182 likewise facilitate cooling of the respective power contacts 24, 124. In particular, the apertures 82, 182 permit the relatively cool air being forced downward over the header and receptacle connectors 12, 14 to impinge upon the top of each tab 42 of the power contacts 24, 124. The impingement of the relatively cool air on the tabs 42 helps to dissipate heat energy from the power contacts 24, 124.

The grooves 48, 148 of the respective housings 22, 122 are configured so that each groove 48 substantially aligns with an associated groove 148 when the header and receptacle connectors 12, 24 are mated. This arrangement can facilitate cooling of the power contacts 24, 124. For example, relatively cool air can be forced over the header and receptacle connectors 12, 14 in the "z" direction, as denoted in FIGS. 1 and 2, by one or more additional cooling fans. The cooling air can enter the rearward ends of the grooves 48. As each groove 48 substantially aligns with a corresponding groove 148 in the housing 122, the cooling air can travel the entire combined width, or "z" dimension, of the header and receptacle connectors 12, 14, and can exit the housing 22 by way of the distal ends of the grooves 148.

The cool air being forced through the grooves 48, 148 passes over the relatively warm body portions 30*a*, 30*b* of the power contacts 24, 124. The air dissipates heat energy from the body portions 30*a*, 30*b* through convective heat transfer, and thereby cools the power contacts 24, 124.

The recesses 92, 94 and the cavity 71 formed in the housing 22, and the PCB 16 define a passage 98, as discussed above. The passage 98 can facilitate cooling of the power contacts 24. In particular, relatively cool air can be forced into and through the passage 98 in the "x" direction, as denoted in FIG. 1, by one or more additional cooling fans. The S-shaped portions 31 and the adjoining terminal pins 32 of the power contacts 24 are partially located within the passage 98, as shown in FIG. 2. The air flowing through the passage 98 can flow over and under the S-shaped portions 31, and between the terminal pins 32. The relatively cool air dissipates heat energy from the power contacts 24 through convective heat transfer, thereby cooling the power contacts 24.

The recesses 192, 194 and the cavity 171 formed in the housing 122, and the PCB 18 define a passage 198, as discussed above. The passage 198 can facilitate cooling of the power contacts 124 of the receptacle connector 14, in the manner discussed above in relation to the passage 98.

The above described air-circulation features of the header and receptacle contacts 12, 14 facilitate three-dimensional circulation of cooling air within the header and receptacle contacts 12, 14. The cooling of the power contacts 24, 124 facilitated by these features can permit the power contacts 24, 124 to operate at higher currents than would otherwise be possible. In particular, the maximum current rating of power contacts 24, 124 may be limited by the maximum acceptable temperature rise in the power contacts 24, 124. The heat dissipation facilitated by some or all of the above-described air-circulation features can permit the power contacts 24, 124 to operate at a higher current, with the same temperature rise as experienced in an application where the power contacts 24, 124 are not cooled. Thus, the maximum rated current of the power contacts 24, 124 can be increased without substantially increasing the temperature rise therein.

The above-described airflow patterns, and the airflow patterns denoted in the figures are presented for illustrative purposes only. The airflow patterns through and around the header and receptacle connectors 12, 14 can be more complex that the patterns described and illustrated herein. Moreover, the airflow patterns can change when the orientations of the header and receptacle connectors 12, 14 are different than those denoted in the figures.

Different airflow patterns can be created by directing the cooling air at the header and receptacle connectors 12, 14 from directions other than those described herein. Also, the header and receptacle connectors 12, 14 can be operated without forced-air cooling; heat dissipation in this type of application can be achieved primarily through natural convection.

The foregoing description is provided for the purpose of explanation and is not to be construed as limiting the invention. Although the invention has been described with reference to preferred embodiments or preferred methods, it is understood that the words which have been used herein are words of description and illustration, rather than words of limitation. Furthermore, although the invention has been described herein with reference to particular structure, methods, and embodiments, the invention is not intended to be limited to the particulars disclosed herein, as the invention extends to all structures, methods and uses that are within the scope of the appended claims. Those skilled in the relevant art, having the benefit of the teachings of this specification, may effect numerous modifications to the invention as described herein, and changes may be made without departing from the scope and spirit of the invention as defined by the appended claims.

Figure 14:
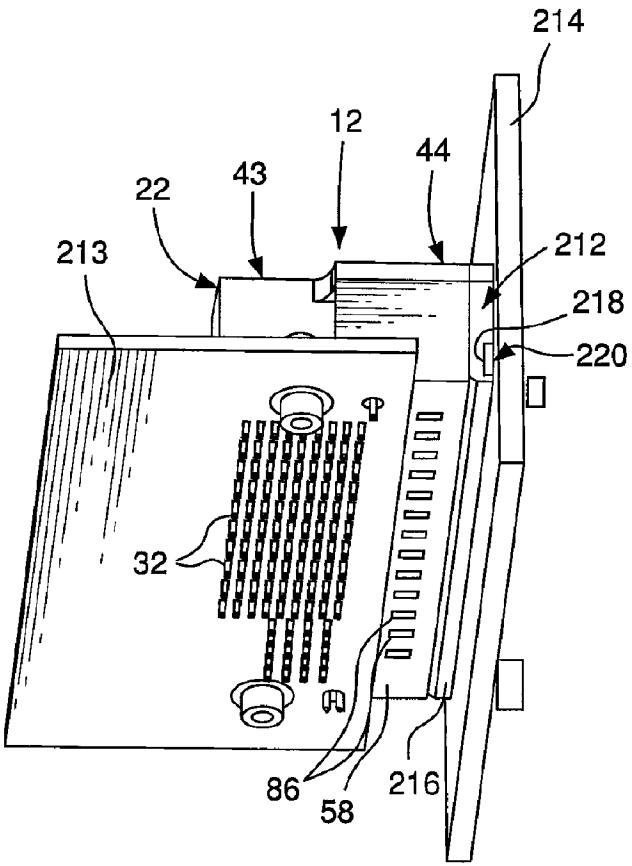
FIG. 14 is a bottom perspective view of the connector system shown in FIG. 13, depicting the header connector and the receptacle connector in the fully mated condition
Figure 13:
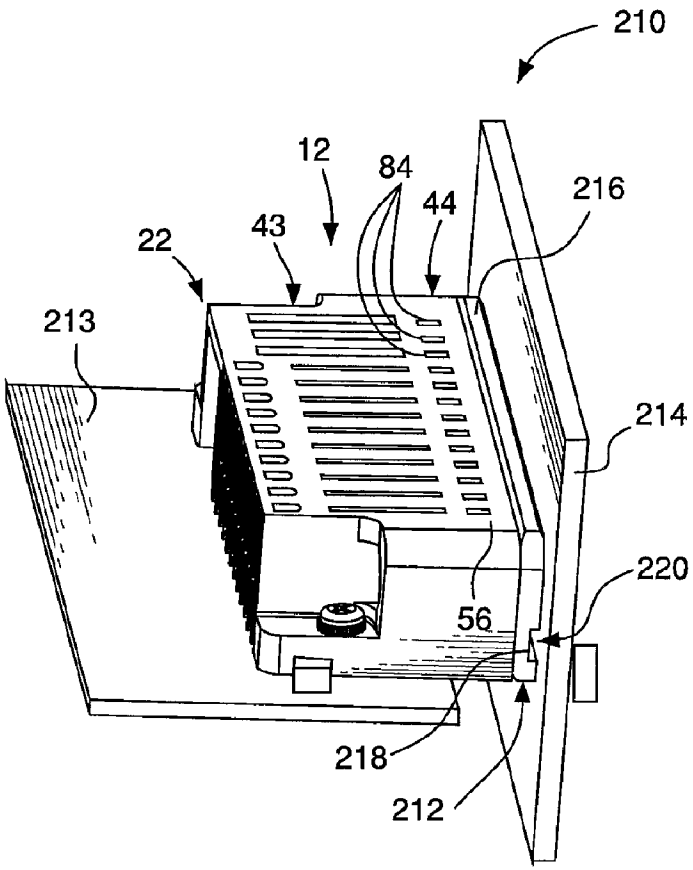
FIG. 13 is a top perspective view of an alternative embodiment of the connector system shown in FIGS. 1-12, depicting a header connector and a receptacle connector of the connector system in a fully mated condition.

For example, FIGS. 13 and 14 depict an alternative embodiment in the form of a connector system 210. The connector system 210 is configured for use as a backplane connector system. The connector system 210 can include the header connector 12 described above in relation to the connector system 10. The connector system 210 can also include a vertical receptacle connector 212 that mates with the header connector 12. The header connector 12 can be mounted on a daughter card 213. The receptacle connector 212 can be mounted on a motherboard 214 that is oriented substantially perpendicular to the daughter card 213.

The receptacle connector 212 can have features substantially similar or identical to those described above in relation to the receptacle connector 14 for facilitating air circulation through and around the receptacle connector 212. For example, the receptacle connector 212 can have a housing 216 with a mating portion (not shown) that is received by the mating portion 43 of the header connector 12 when the header and receptacle connectors 12, 212 are mated. The mating portion of the housing 216 can have apertures formed in top and bottom potions thereof. The apertures can align with the apertures 84, 184 formed in the mating portion 44 of the header connector 12.

The housing 216 of the receptacle connector 212 can have one or more recesses 218 formed therein. The recesses 218 and the motherboard 214 can define a passage 220 that facilitates air circulation between the housing 216 and the motherboard 214, in the manner discussed above in relation to the passage 198 defined by the receptacle connector 14 and the PCB 18.

FIGS. 15-21 depict an alternative embodiment of the header connector 12 in the form of a header connector 300. The header connector 300, except where otherwise noted, can be substantially similar or identical to the header connector 12.

The header connector 300 includes a housing 301, short power contacts 302, and long power contacts 304. The short power contacts 302 are received in cavities 306 formed in the housing 301. The long power contacts 304 are received in cavities 308 formed in the housing 301.

Figure 15:
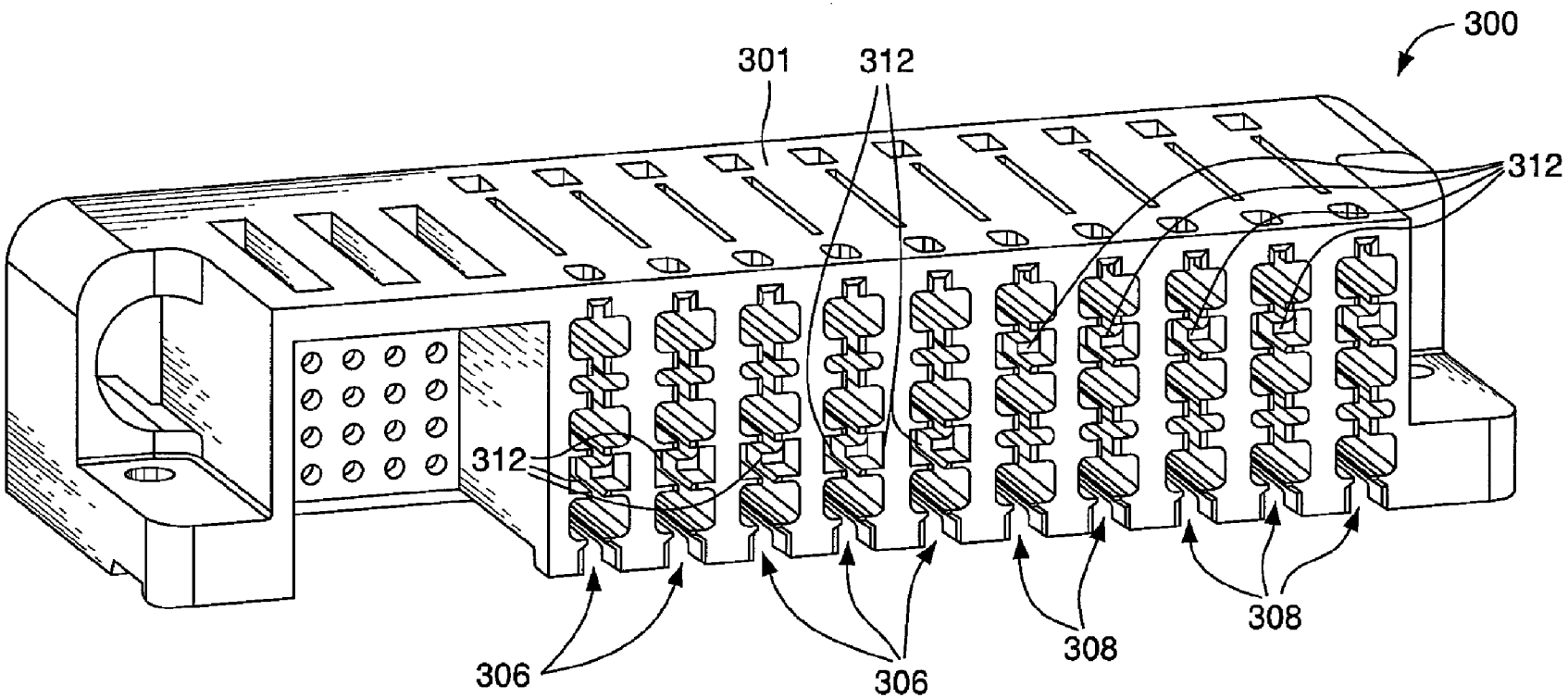
FIG. 15 is a rear perspective view of a housing of another alternative embodiment of the connector system shown in FIGS. 1-12.
Figure 17:
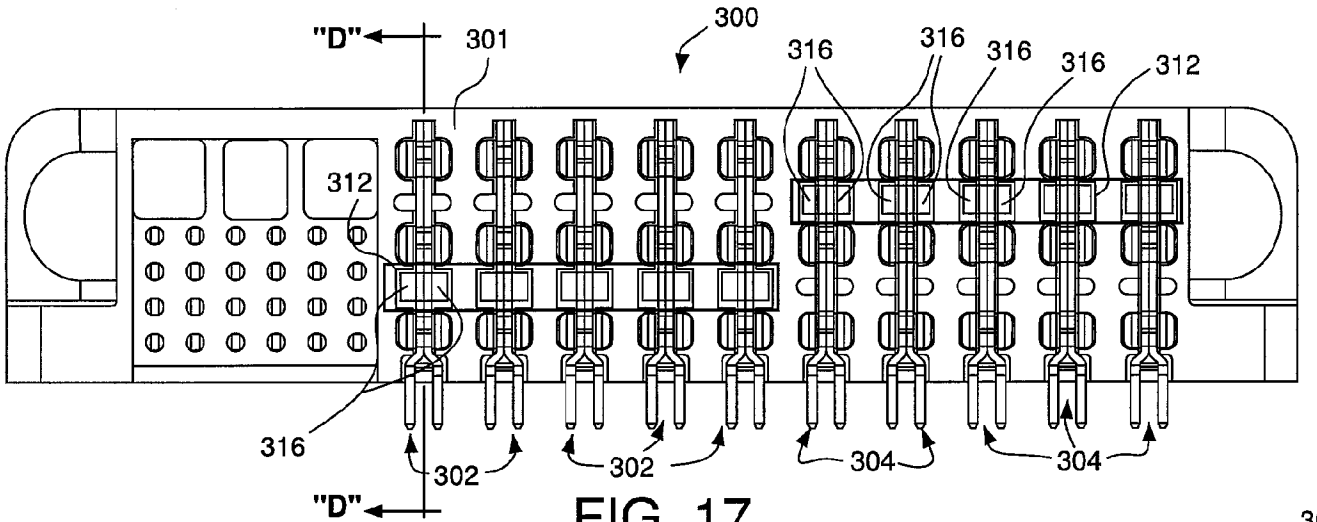
FIG. 17 is rear view of the connector system shown in FIGS. 15-16B, depicting the short and long power contacts correctly installed in associated cavities in the housing.
Figure 18:
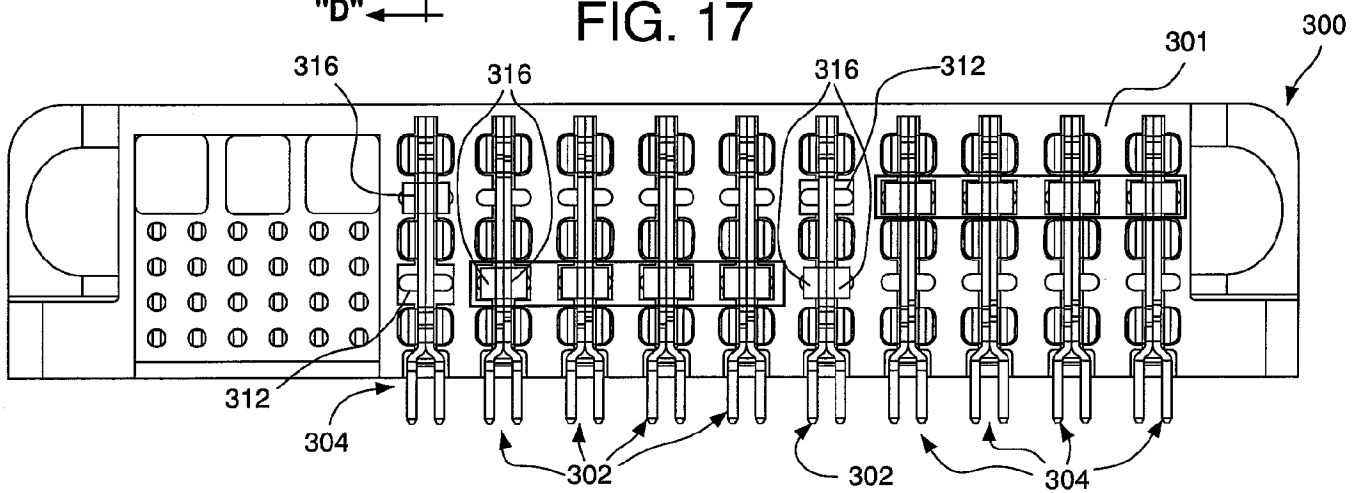
FIG. 18 is a rear view of the connector system shown in FIGS. 15-17, depicting one of the short and one of the long power contacts incorrectly correctly installed in associated cavities in the housing.

The housing 301, the short power contacts 302, and the long power contacts 304 include polarizing features that prevent the short power contacts 302 from being inserted into the cavities 308, or the long power contacts 304 from being inserted into the cavities 306. In particular, each cavity 306, 308 has a window 312 formed therein. The window 312 associated with each cavity 306 is located proximate a lower end of the cavity 306, as shown in FIGS. 15, 17, and 18. The window 312 associated with each cavity 308 is located proximate an upper end of the cavity 306.

Figure 16A:
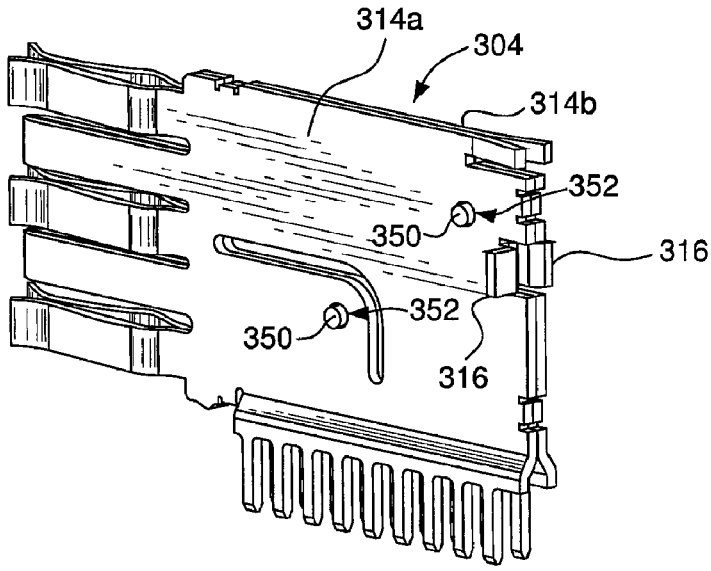
FIGS. 16A and 16B are rear perspective views of a respective long and short power contact of the connector system shown in FIG. 15.
Figure 16B:
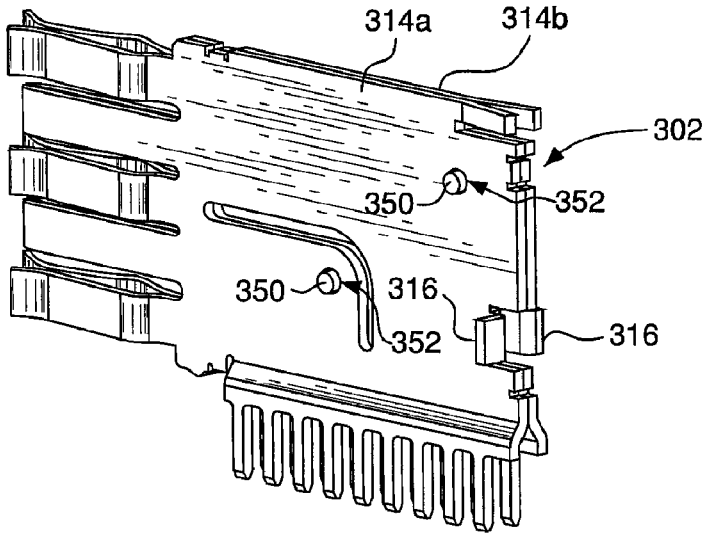

The short and long power contacts 302, 304 each include body members 314*a*, 314*b*, as shown in FIGS. 16A and 16B. The short and long power contacts 302, 304 also include tabs 316 located proximate the rearward edges of each body member 314*a*, 314*b*. The tabs 316 extend in directions substantially perpendicular to the major surfaces of the body members 314*a*, 314*b*. The tabs 316 of each short power contact 302 are located proximate a lower end of the short power contact 302. The tabs 316 of each long power contact 304 are located proximate an upper end of the long power contact 304.

The tabs 316 are sized to fit within the windows 312 of the housing 301. The windows 312 associated with the cavities 306, and the tabs 316 of each short power contact 302 are positioned so that the tabs 316 of the short power contacts 302 each align with, and are received by an associated one of the windows 312 of the cavities 306 when the short power contacts 302 are inserted into the cavities 306, as shown in FIG. 17.

Figure 19:
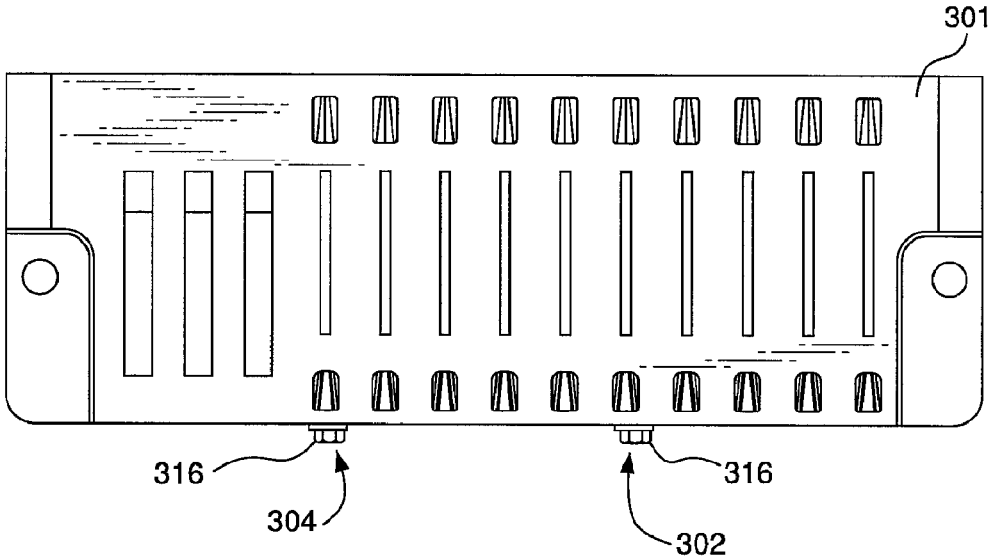
FIG. 19 is a top view of the connector system shown in FIGS. 15-18, depicting one of the short and one of the long power contacts incorrectly correctly installed in associated cavities in the housing.
Figure 20:
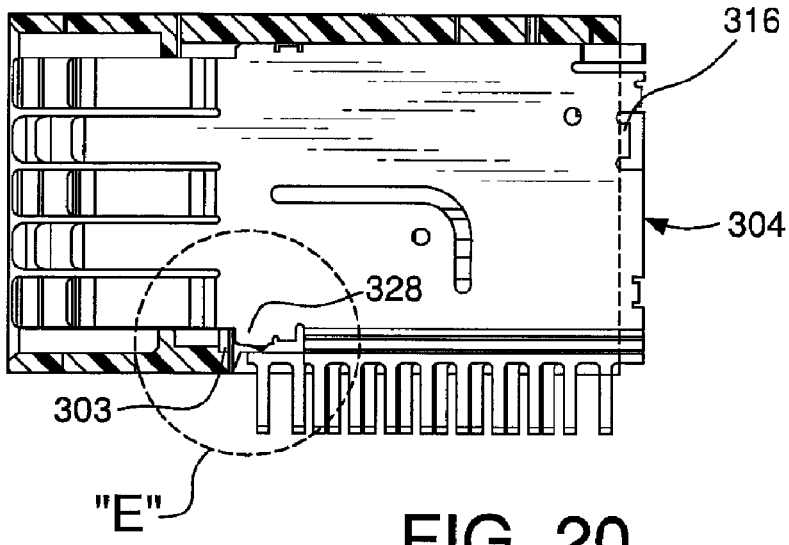
FIG. 20 is a cross-sectional view of the connector system shown in FIGS. 15-19, taken through the line "D-D" of FIG. 17.
Figure 21:
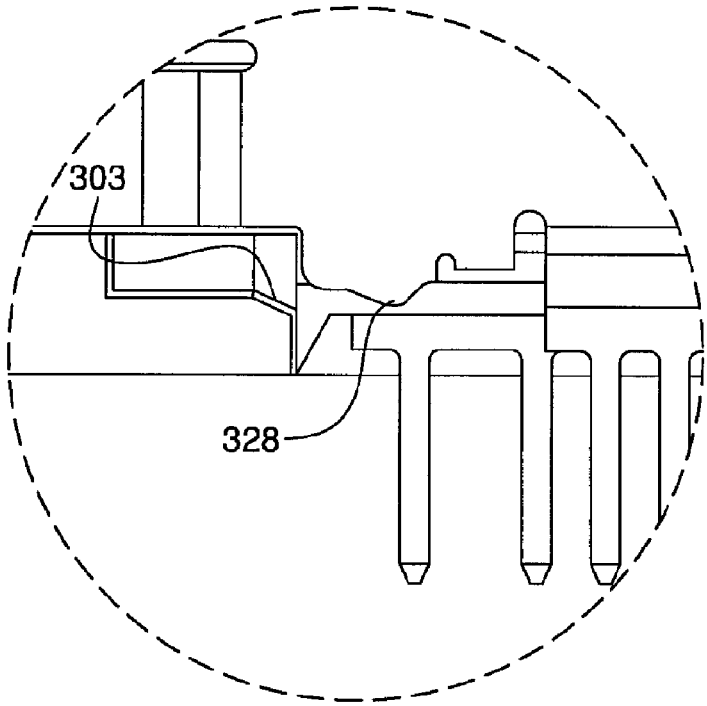
FIG. 21 is a magnified view of the area designated "E" in FIG. 20.
Figure 22A:
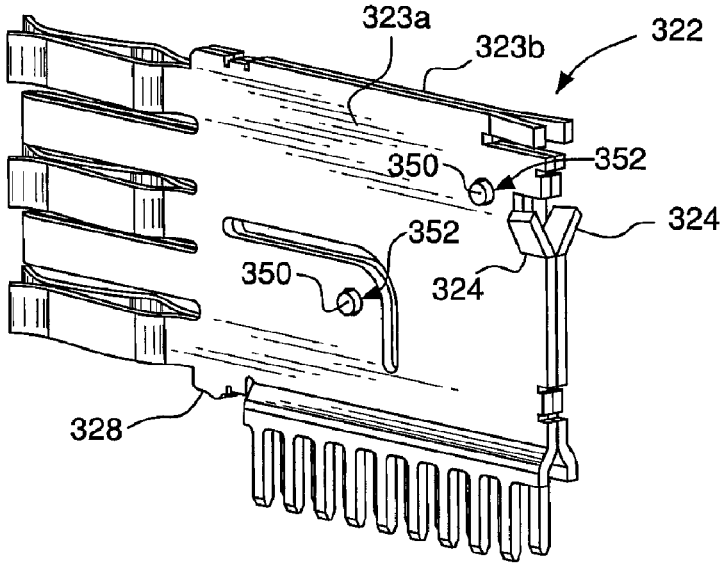
FIGS. 22A and 22B are perspective views of a respective long and short power contact of another alternative embodiment of the connector system shown in FIGS. 1-12.
Figure 22B:
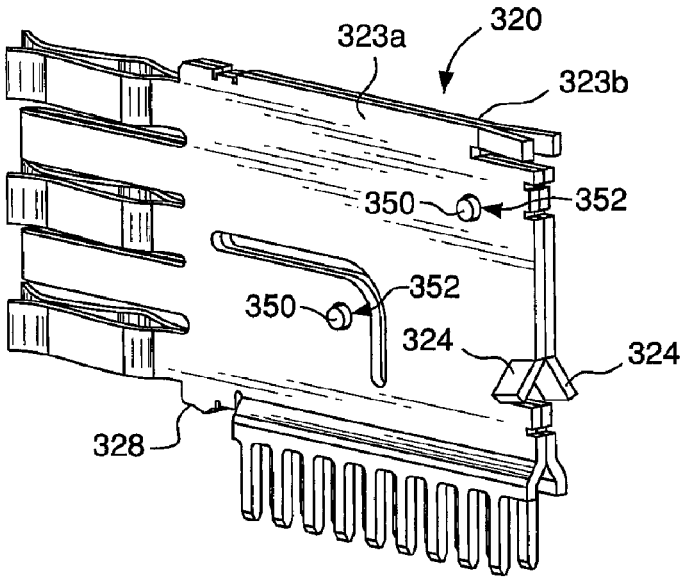
Figure 23:
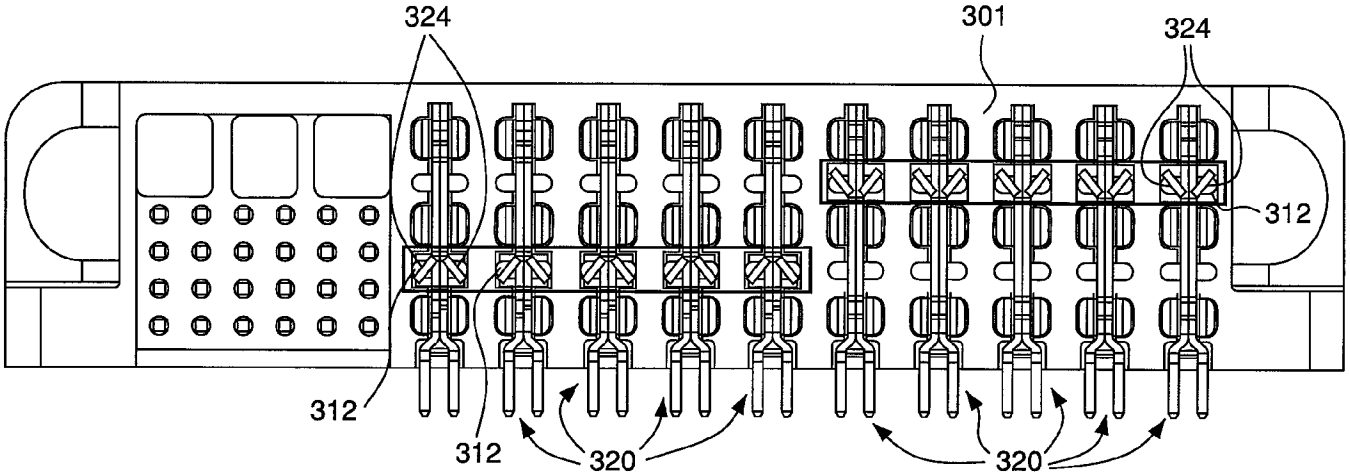
FIG. 23 a rear view of the connector system shown in FIGS. 15-16B, depicting the short and long power contacts correctly installed in associated cavities in a housing of the connector system.
Figure 24:
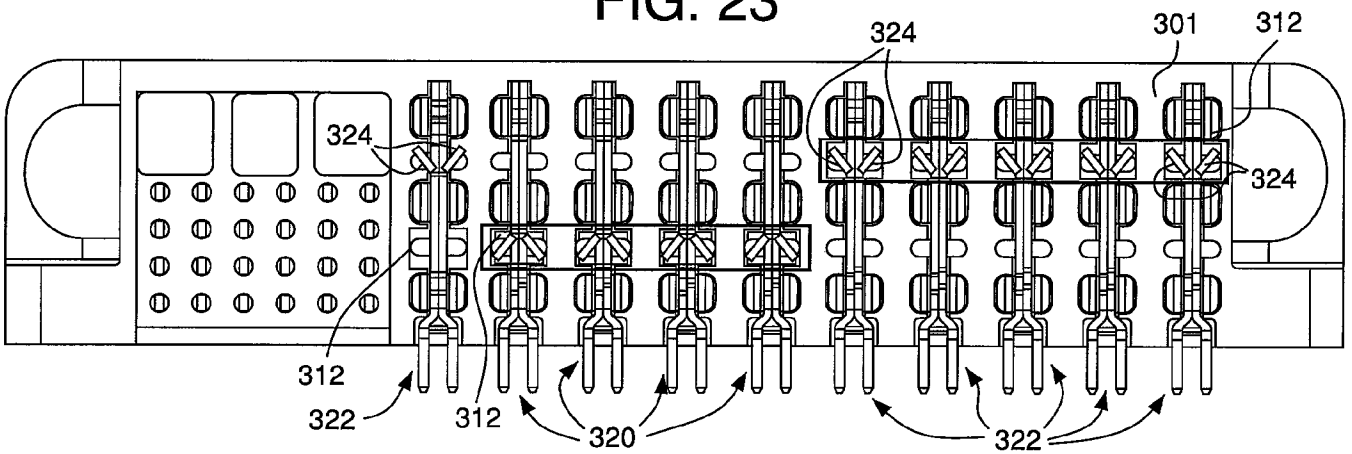
FIG. 24 is a rear view of the connector system shown in FIGS. 22A-23, depicting one of the short and one of the long power contacts incorrectly correctly installed in associated cavities in the housing.

The tabs 316 of the short power contacts 302 do not align with the windows 312 associated with the cavities 308 when an attempt is made to insert one of the short power contacts 302 into one of the cavities 308. Rather, interference between the tabs 316 and the housing 301 prevents the short power contact 302 from advancing into the cavity 308, as shown in FIGS. 18 and 19.

The windows 312 associated with the cavities 308, and the tabs 316 of each long power contact 304 likewise are positioned so that the tabs 316 of the long power contacts 304 align with, and are received by the windows 312 of the cavities 308 when the long power contacts 304 are inserted into the cavities 308, as shown in FIG. 17.

The tabs 316 of the long power contacts 304 do not align with the windows 312 associated with the cavities 306 when an attempt is made to insert one of the long power contacts 304 into one of the cavities 306. Rather, interference between the tabs 316 and the housing 301 prevents the long power contact 304 from advancing into the cavity 306, as shown in FIGS. 18 and 19.

The body members 314*a*, 314*b* of the short and long power contacts 302, 304 each include a tab 328, as shown in FIGS. 16A, 16B, 20, and 21. The tabs 328 interferedly engage the housing 301 when the short and long power contacts 302, 304 are fully inserted into the housing 301. Interference between the tabs 328 and the housing 301 helps to retain the short and long power contacts 302, 304 in the housing 301. The housing 301 includes a ramp 303 that helps to guide the tabs 328 into their final positions as the body members 314*a*, 314*b* are inserted into the housing 301.

The above-noted noted interference between the tabs 316 of the long power contacts 304 and the housing 301 when the long power contacts 304 are inadvertently installed in the cavities 306 can prevent the long power contacts 304 from advancing far enough into the cavities 306 for the associated tabs 328 to interferedly engage the associated ramps 303 of the housing 301. The above-noted noted interference between the tabs 316 of the short power contacts 302 and the housing 301 when the short power contacts 302 are inadvertently installed in the cavities 308 can likewise prevent the short power contacts 302 from advancing far enough into the cavities 308 for the associated tabs 328 to interferedly engage in the associated ramps 303.

The second half 314*b* of each short and long power contact 302, 304 can include two cylindrical projections 350, as shown in FIGS. 16A and 16B. The first half 314*a* of each short and long power contact 302, 304 can include two circular holes 352 that each receive one of the projections 350. The relative positions of the two sets of projections 350 and holes 352 on the short power contacts 302 can differ from the relative locations of the two sets of projections 350 and holes 352 on the long power contacts 304. The projections 350 and holes 352 can thus act as polarizing features that prevent the first half of a short power contact 302 from being inadvertently mated with the second half of a long power contact 304, and vice versa.

The projections 350 and holes 352 can have respective shapes other than cylindrical and circular in alternative embodiments. Moreover, the projections 350 and the holes 352 can be located on the first and second halves 323*a*, 323*b*, respectively, of the short and long power contacts 302, 304 in alternative embodiments.

FIGS. 22A through 24 depict alternative embodiments of the short and long power contacts 302, 304 in the form of a short power contact 320 and a long power contact 322. The short and long power contacts 320, 322 are substantially similar to the respective short and long power contacts 302, 304 from a structural and functional perspective, with the exception that the short and long power contacts 320, 322 include tabs 324 that angle outwardly and downwardly from the associated body members 323*a*, 323*b* of the short and long power contacts 320, 322.

What is claimed:

1. An electrical connector system for mounting on a substrate comprising:

a first electrical connector comprising a first power contact and a first electrically insulative housing that receives the first power contact, wherein: a first aperture is formed in the first housing; the first aperture is aligned with a mating portion of the first power contact whereby air heated by the first power contact can exit the first power contact by way of the first aperture; a first recess is formed in the first housing; the first recess is positioned to face the substrate so that the first recess and the substrate define a first passage extending from a side portion of the first housing when the first electrical connector is mounted on the substrate; and a portion of the first power contact extends through the first recess; whereby air from the environment around the first electrical connector can pass between the first housing and substrate and over the first power contact when the first electrical connector is mounted on the substrate;

a second electrical connector that mates with the first electrical connector, the second electrical connector comprising a second power contact and a second electrically insulative housing that receives the second power contact, wherein a second aperture is formed in the second housing, the second aperture is aligned with a mating portion of the second power contact whereby air heated by the second power contact can exit the second power contact by way of the second aperture; a second recess is formed in the second housing; wherein the first recess, the first aperture, the second recess and the second aperture are interconnected when the first and second electrical connectors are mated; and a third power contact, wherein (i) the first and third power contacts each comprises a tab, (ii) the first housing comprises a first and a second cavity formed therein that receive the respective first and third power contacts, and (iii) the tab of the first power contact interferedly contacts the first housing when the first power contact is partially inserted into the second cavity thereby preventing installation of the first power contact in the second cavity, and the tab of the third power contact interferedly contacts the first housing when the third power contact is partially inserted into the first cavity thereby preventing installation of the third power contact in the first cavity.

2. The connector system of claim 1, wherein a another aperture is formed in the first housing and is aligned with the first aperture and the mating portion of the first power contact, whereby air heated by the first power contact can circulate over the mating portion of the first power contact by way of the apertures.

3. The electrical connector system of claim 1, wherein the first aperture of the first electrical connector overlaps with the second aperture of the second electrical connector when the first and second electrical connectors are mated together.

4. The electrical connector system of claim 1, wherein the first electrical connector further comprises the third power contact.

5. The connector system of claim 1, wherein the first power contact comprises a terminal pin that engages the substrate, and a portion of the terminal pin is located within the first recess formed in the bottom portion of the first housing.

6. The connector system of claim 5, wherein the first power contact further comprises a plate-like body member and a substantially S-shaped portion that adjoins the body member and the terminal pin, wherein the a portion of the S-shaped portion is located within the first recess.

7. The connector system of claim 1, wherein the first power contact comprises a plurality of contact beams and the first aperture is aligned with the contact beams.

8. The connector system of claim 7, wherein the contact beams are located in a cavity defined by the first housing and the first aperture places the cavity in fluid communication with the environment around the first electrical connector.

9. The connector system of claim 8, wherein the first aperture is located above the contact beams, and another aperture is formed in the first housing below the contact beams whereby air can circulate through the cavity and over the contact beams by way of the apertures.

10. The connector system of claim 8, wherein the first aperture facilitates air circulation in a first direction, and the first recess facilitates air circulation in a second direction substantially perpendicular to the first direction.

11. The connector system of claim 10, wherein an end of the cavity is in fluid communication with the environment around the first electrical connector, and the cavity extends substantially in a third direction substantially perpendicular to the first and second directions whereby the cavity facilitates air circulation in the third direction.

12. An electrical connector, comprising:

an electrically insulative housing; and a first power contact mounted in the housing and having a mating portion, wherein the housing has an aperture formed therein and aligned with the mating portion of the first contact whereby air heated by the power contact can exit the power contact by way of the aperture; and a second power contact, wherein (i) each power contact comprises a tab, (ii) the housing comprises a first and a second cavity formed therein that receive the respective first and second power contacts, and (iii) the tab of the first power contact interferedly contacts the housing when the first power contact is partially inserted into the second cavity thereby preventing installation of the first power contact in the second cavity, and the tab of the second power contact interferedly contacts the housing when the second power contact is partially inserted into the first cavity thereby preventing installation of the second power contact in the first cavity.

13. The electrical connector of claim 12, configured to mate with a corresponding connector such that the aperture overlaps with a complementary aperture of the corresponding connector.

14. The electrical connector of claim 12, wherein (i) a passage is defined by the housing and a substrate when the electrical connector is mounted on the substrate, (ii) the passage extends from a first side of the housing to an opposite second side of the housing, (iii) a portion of the power contact extends into the passage, (iv) at least a portion of the aperture terminates at the passage, and (v) whereby air from the environment around the electrical connector can pass between the housing and substrate and over the power contact.

15. The electrical connector of claim 12, wherein the housing has a top portion having the aperture formed therein, and a bottom portion having another aperture formed therein and aligned with the mating portion of the contact.

16. The electrical connector of claim 15, wherein the bottom portion of the housing has a recess formed therein, and the power contact extends through the recess.

17. An electrical connector, comprising:

a first power contact comprising a tab;

a second power contact comprising a tab; and a housing having a first and a second cavity formed therein that receive the respective first and second power contacts, wherein the tab of the first power contact interferedly contacts the housing when the first power contact is partially inserted into the second cavity thereby preventing installation of the first power contact in the second cavity, and the tab of the second power contact interferedly contacts the housing when the second power contact is partially inserted into the first cavity thereby preventing installation of the second power contact in the first cavity.

18. The electrical connector of claim 17, wherein:

the first power contact includes a first and a second half, the first half having a first and a second projection formed thereon, and the second half having a first and a second hole formed therein that each receive an associated one of the projections when the first half is stacked against the second half, the projections being spaced apart on the first half by a first distance; and the second power contact includes a first and a second half, the first half of the second power contact having a first and a second projection formed thereon, and the second half of the second power contact having a first and a second hole formed therein that each receive an associated one of the projections of the second power contact when the first half of the second power contact is stacked against the second half of the second power contact, the projections formed on the first half of the second power contact being spaced apart by a second distance different that the first distance.

19. The electrical connector of claim 17, wherein the first power contact and the second power contact are of different sizes.

20. The electrical connector of claim 17, wherein the tab of the first power contact is disposed at a first location relative to an upper surface of the first power contact, and the tab of the second power contact is disposed at a second location relative to an upper surface of the second power contact, and the second location is different than the first location.

21. The electrical connector of claim 17, wherein the first cavity includes a window that receives the tab of the first power contact, and the second cavity includes a window that receives the tab of the second power contact.

22. The electrical connector of claim 21, wherein the window of the first cavity and the tab of the second power contact are misaligned when the second power contact is partially inserted into the first cavity; and the window of the second cavity and the tab of the first power contact are misaligned when the first power contact is partially inserted into the second cavity.

23. The electrical connector of claim 17, configured to be mounted on a substrate, wherein an aperture is formed in the housing; the aperture is aligned with a mating portion of the first power contact whereby air heated by the first power contact can exit the first power contact by way of the aperture; a recess is formed in the housing; the first recess is positioned to face the substrate so that the recess and the substrate define a passage extending from a side portion of the first housing when the electrical connector is mounted on the substrate; and a portion of the first power contact extends through the recess such that air from the environment around the first electrical connector can pass between the first housing and the substrate and over the first power contact when the first electrical connector is mounted on the substrate.

24. The electrical connector of claim 23, wherein the recess and the aperture are configured to interconnect with a corresponding recess and aperture of a complementary connector when the electrical connector is mated with the complementary connector.

* * * * *